United States Patent [19]

Atsumi et al.

[11] Patent Number: 5,008,584

[45] Date of Patent: Apr. 16, 1991

[54] SPARK PLUG HAVING A BUILT-IN RESISTOR FOR SUPPRESSING NOISE SIGNALS

[75] Inventors: Morihiro Atsumi, Okazaki; Kiyoaki Tanaka, Obu, both of Japan

[73] Assignee: Nippondenso Co., Ltd., Kariya, Japan

[21] Appl. No.: 375,978

[22] Filed: Jul. 6, 1989

[30] Foreign Application Priority Data

Jul. 6, 1988 [JP] Japan ..... 63-168533

[51] Int. Cl.[5] ..... H01T 13/05

[52] U.S. Cl. ..... 313/136; 313/134; 313/144; 313/145; 252/503; 252/504; 252/507

[58] Field of Search ..... 313/134, 136, 144, 145; 252/503, 504, 507, 509, 511

[56] References Cited

U.S. PATENT DOCUMENTS

| | | | |
|---|---|---|---|
| 3,909,459 | 9/1975 | Friese et al. | 252/507 |
| 4,173,731 | 11/1979 | Takagi et al. | 252/504 |

FOREIGN PATENT DOCUMENTS

| | | |
|---|---|---|
| 49-68131 | 7/1974 | Japan . |
| 50-144830 | 11/1975 | Japan . |
| 57-17587 | 1/1982 | Japan . |
| 57-105988 | 7/1982 | Japan . |
| 61-104580 | 5/1986 | Japan . |

*Primary Examiner*—Donald J. Yusko
*Assistant Examiner*—Diab Hamadi
*Attorney, Agent, or Firm*—Cushman, Darby & Cushman

[57] ABSTRACT

A spark plug containing a resistor which is a sintered body made from a mixture comprising coarse glass particles and fine glass particles, coarse ceramic particles and fine ceramic particles, and carbon black in special proportions is improved in noise signal suppression effect.

23 Claims, 7 Drawing Sheets

SPARK PLUG HAVING A BUILT-IN RESISTOR FOR SUPPRESSING NOISE SIGNALS

BACKGROUND OF THE INVENTION

This invention relates to a spark plug having a built-in resistor effective for suppressing noise signals.

There have been proposed spark plugs having various kinds of built-in resistors. For example, Japanese Patent Unexamined Publication No. 50-144830 discloses a spark plug comprising an insulator having a centerbore therethrough, a center electrode, and a resistor sealed together with conductive glass seals in the centerbore, said resistor being obtained by sintering a resistor powder mixture comprising tin oxide as a major resistor powder, an electrical insulating ceramic powder such as zirconia powder having a particle size of 177 μm and a glass powder having a softening temperature of 300° to 600° C. Japanese Patent Unexamined Publication No. 57-105988 discloses a spark plug comprising an insulator having a centerbore therethrough, a center electrode and a resistor sealed together with conductive glass seals in the centerbore, said resistor being obtained by sintering a resistor powder mixture comprising an electrical insulating ceramic powder such as carbon black, zirconia, or the like, and two different kinds of glass powders. Further, Japanese Patent Unexamined Publication No. 61-104580 discloses a spark plug comprising an insulator having a centerbore therethrough, a center electrode and a resistor sealed together with conductive glass seals in the centerbore, said resistor being obtained by sintering a resistor powder mixture comprising a carbon powder, a glass powder having a larger particle size than that of carbon powder in the range of 5 μm to 80 μm, and a glass powder having a larger particle size than the former glass powder in the range of 50 μm to 300 μm.

But these spark plugs are insufficient in noise signal suppression effect.

The present inventors have studied causes of such insufficiency in noise signal suppression effect and found that boundary surfaces between the resistor and conductive glass seals sandwiching the resistor were curved to substantially reduce a resistance value due to substantial shortening of the resistor length, resulting in insufficient effect for suppressing noise signal.

SUMMARY OF THE INVENTION

It is an object of the present invention to provide a spark plug overcoming the disadvantages of known resistors and improved in noise signal suppression effect by suppressing curving of boundary surfaces of a resistor and conductive glass seals sandwiching the resistor.

The present invention provides a spark plug comprising an insulator having a bore therein along an axis direction, a terminal electrode inserted from one opening of the bore of the insulator and fixed therein, a center electrode inserted from another opening of the bore of the insulator and fixed therein, a resistor placed between the terminal electrode and the center electrode in the bore of the insulator, and conducting glass seals placed between one end of the resistor and the terminal electrode, and between another end of the resistor and the center electrode, said resistor being a sintered body made from a mixture of glass powders, electrical insulating ceramic powders and a carbon black powder in an amount of 0.1 to 2.5% by weight based on 100% by weight of a total of the glass powders and the ceramic powders, said glass powders comprising coarse glass particles of 177 μm to 840 μm in particle size and fine glass particles of 74 μm or less in particle size, and said ceramic powders comprising coarse ceramic particles, e.g. of molten alumina or silica, of 177 μm to 840 μm in particle size and fine ceramic particles of 10 μm or less in particle size.

DESCRIPTION OF PREFERRED EMBODIMENTS

Figure 1:
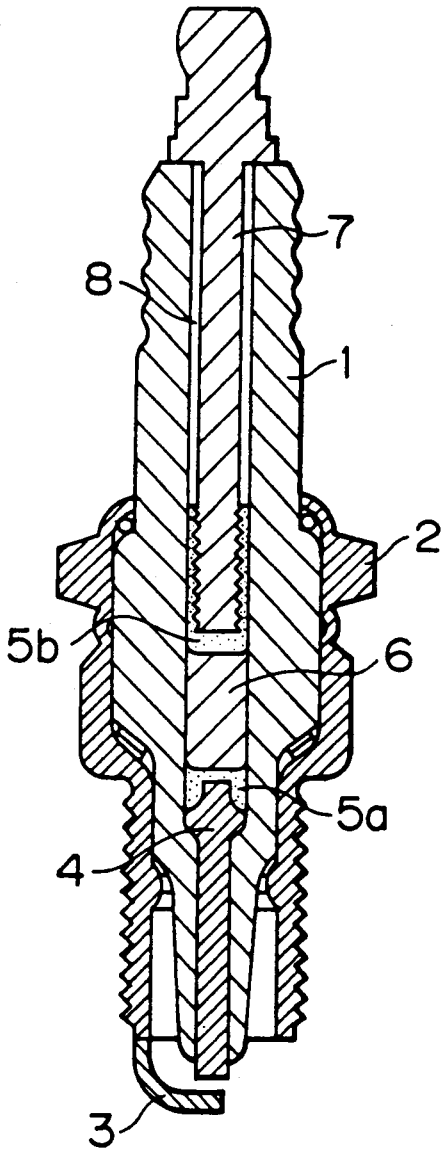
FIG. 1 is a cross-sectional view of one example of the spark plug of the present invention.

The present inventors investigated causes for curving the boundary surfaces of a built-in resistor of a spark plug and found that the curving (a hollow) was brought about by non-uniform dispersion of pressure applied to softened materials of resistor materials, and a conducting glass sealing material in a bore of an insulator of the spark plug during the production of spark plug.

In order to prevent such curving (or hollowing), it is necessary to produce a resistor, which is placed between a terminal electrode and a center electrode in a centerbore of an insulator, a space between one end of the resistor and the terminal electrode and a space between another end of the resistor and the center electrode being filled with conducting glass seals, by sintering a powder mixture comprising glass powders, electrical insulating ceramic powders and a carbon black powder in an amount of 0.1 to 2.5% by weight based on 100% by weight of a total of the glass powders and the ceramic powders, the amount of the glass powders (a) being preferably 40.0% to 75.8% by weight and that of the ceramic powders being preferably 60.0% to 24.2% by weight, a total being 100% by weight depending on kinds of ceramic powders used.

Further, the glass powders should comprise coarse glass particles of 177 μm to 840 μm in particles size and fine glass particles of 74 μm or less in particle size, the proportion of the coarse glass particles (b) being preferably 0.39 to 0.99, a total of the coarse glass particles and the fine glass particles being 1, depending on kinds of ceramic powders used.

In addition, the ceramic powders should comprise coarse ceramic particles (preferably obtained from molten alumina or molten silica) of 177 μm to 840 μm in particle size and fine ceramic particles of 10 μm or less in particle size, the proportion of the coarse ceramic particles (c) being preferably 0.20 to 0.85, a total of the coarse ceramic particles and the fine glass particles being 1, depending on kinds of ceramic powders used.

More in detail, in the case of using molten alumina as the coarse ceramic particles having a particle size of 177 μm to 840 μm, and providing that the density of fine ceramic particles having a particle size of 10 μm or less is "x" g/cm$^3$, the amount of the glass powders (a) in % by weight is preferably in the range between the formulae (1) and (2):

$$65.7-7.5x+0.5x^2 \quad (1)$$

$$82.2-6.1x+0.4x^2 \quad (2)$$

the balance being the amount of the ceramic powders, a total being 100% by weight, the proportion of the coarse glass particles (b) in the glass powders in weight ratio is preferably in the range between the formulae (3) and (4):

$$0.53+0.03x-0.0006x^2 \quad (3)$$

$$0.72+0.06x-0.0030x^2 \quad (4)$$

the balance being the proportion of the fine glass particles, a total being 1, and the proportion of the coarse ceramic particles (i.e. of molten alumina) (c) in the ceramic powders in weight ratio is preferably in the range between the formulae (5) and (6):

$$0.93-0.20x+0.016x^2 \quad (5)$$

$$1.06-0.10x+0.006x^2 \quad (6)$$

the balance being the proportion of the fine ceramic particles, a total being 1.

Further, in the case of using molten silica as the coarse ceramic particles having a particle size of 177 μm to 840 μm, and providing that the density of fine ceramic particles having a particle size of 10 μm or less is "x" g/cm$^3$, the amount of the glass powders (a) in % by weight is preferably in the range between the formulae (') and (2'):

$$78.5-9.7x+0.7x^2 \quad (1')$$

$$90.7-7.0x+0.4x^2 \quad (2')$$

the balance being the amount of the ceramic powders, a total being 100% by weight, the proportion of the coarse glass particles (b) in the glass powders in weight ratio is preferably in the range between the formulae (3') and (4'):

$$-0.33+0.39x-0.038x^2 \quad (3')$$

$$0.58+0.09x-0.005x^2 \quad (4')$$

the balance being the proportion of the fine glass particles, a total being 1, and the proportion of the coarse ceramic particles (i.e. of molten silica) (c) in the ceramic powders in weight ratio is preferably in the range between the formulae (5') and (6'):

$$0.75-0.18x+0.015x^2 \quad (5')$$

$$1.10-0.16x+0.011x^2 \quad (6')$$

the balance being the proportion of the fine ceramic particles, a total being 1.

As the ceramic, molten alumina and molten silica are preferably used for giving the coarse ceramic particles, and silicon nitride (x=3.2 g/cm$^3$), zirconia (x=5.8 g/cm$^3$), alumina (x=3.9 g/cm$^3$), zircon (x=4.8 g/cm$^3$), silica (x=2.6 g/cm$^3$), mullite (x=3.1 g/cm$^3$), titania (x=4.2 g/cm$^3$), and chromium oxide (x=5.2 g/cm$^3$) are preferably used for giving the fine ceramic particles.

There can be employed many combinations between coarse ceramic particles and fine ceramic particles, and between the glass powders and the ceramic powders, but the combinations shown in table 1 are most preferable among various combinations.

TABLE 1

| Coarse ceramic particles | Amount of Fine ceramic particles | Ratio of glass powder (wt %) | Amount of coarse glass particles | coarse ceramic powder (wt %) | Ratio of ceramic particles |
|---|---|---|---|---|---|
| Molten alumina | Silicon nitride | 46.8~66.5 | 0.63~0.89 | 53.2~33.5 | 0.43~0.81 |
| Molten alumina | Zirconia | 40.0~60.0 | 0.70~0.99 | 60.0~40.0 | 0.30~0.70 |
| Molten alumina | Alumina | 44.0~64.0 | 0.65~0.92 | 56.0~36.0 | 0.38~0.77 |
| Molten alumina | Zircon | 42.8~62.7 | 0.67~0.95 | 57.2~37.3 | 0.35~0.74 |
| Molten alumina | Silica | 50.0~69.2 | 0.61~0.86 | 50.0~30.8 | 0.52~0.85 |
| Molten silica | Silicon nitride | 53.9~72.6 | 0.58~0.82 | 46.1~27.4 | 0.30~0.71 |
| Molten silica | Zirconia | 45.1~64.9 | 0.65~0.92 | 54.9~35.1 | 0.20~0.57 |
| Molten silica | Alumina | 50.4~69.7 | 0.60~0.85 | 49.6~30.3 | 0.23~0.65 |
| Molten silica | Zircon | 48.8~68.2 | 0.62~0.87 | 51.2~31.8 | 0.24~0.62 |
| Molten | Silica | 58.2~75.8 | 0.39~0.77 | 41.8~24.2 | 0.39~0.77 |

TABLE 1-continued

| Coarse ceramic particles | Amount of Fine ceramic particles | Ratio of glass powder (wt %) | Amount of coarse glass particles | coarse ceramic powder (wt %) | Ratio of ceramic particles |
|---|---|---|---|---|---|
| silica | | | | | |

When the glass powders and the ceramic powders are in special ranges, preferably in the ranges as represented by the formulae (1) to (6) or (1') to (6'), the coarse glass particles and the coarse ceramic particles are present in a mixed state in the resistor material. At the time of heat treatment and press treatment during the production of spark plugs, the press pressure can be dispersed in directions of ranges of coarse glass particles and coarse ceramic particles, that is, can be dispersed into whole resistor materials, which probably results in suppressing the curving of boundary surfaces between the resistor and conducting glass seals. In order to obtain such an action, the coarse glass particles in the glass powders should maintain the shapes of glass particles even by the above-mentioned heat treatment. In order to meet such a requirement, the glass is required not to be melted at the above-mentioned heat treatment temperature and to have a particle size of at least 177 μm.

Figure 5:
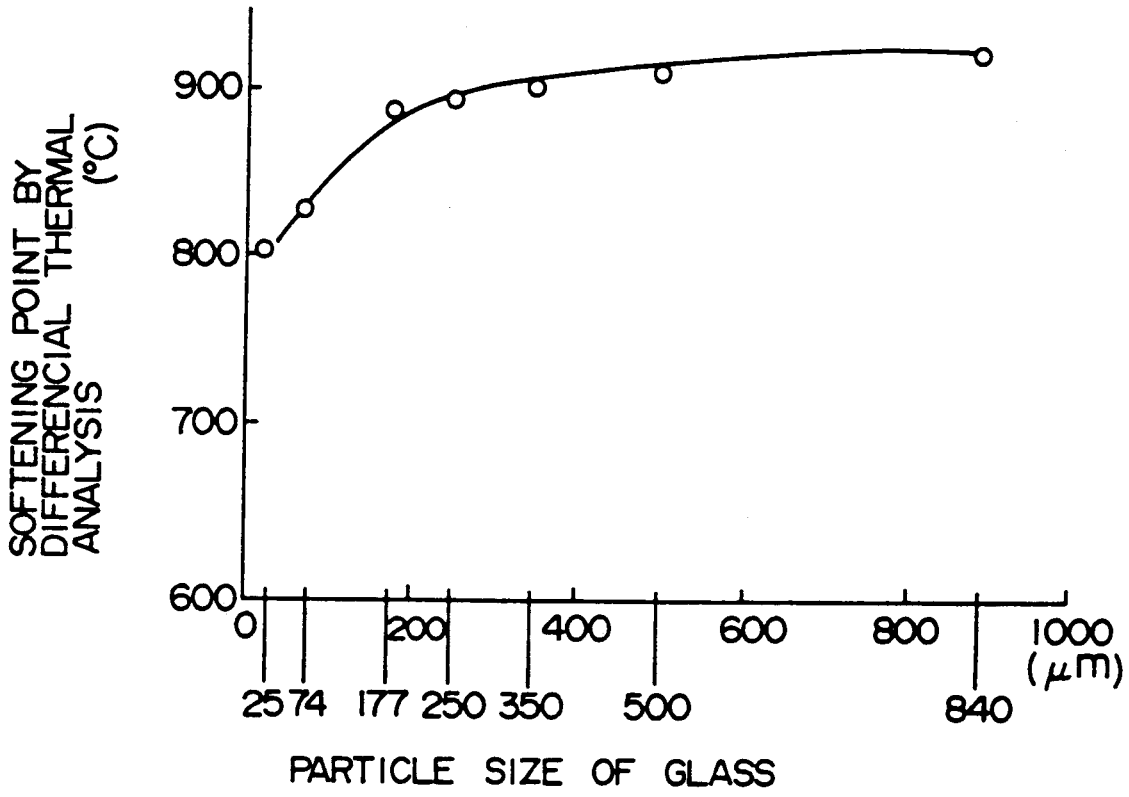
FIG. 5 is a graph showing a relationship between particle sizes of glass powders and softening temperatures measured by differential thermal analysis.

This is based on the experimental results conducted by the present inventors and shown in FIG. 5 wherein the softening temperatures measured by differential thermal analysis change depending on particle sizes of glass. Coarse glass particles having a particle size of large than 177 μm have a softening temperature of about 900° C. and do not melt at the heat treatment temperature (generally 850° C.) mentioned above. As mentioned above, glass particles having larger particle sizes do not reach melting, but become a state of softened state on the particle surfaces to some depth, while retaining core portions at the time of heat treatment as mentioned above. Thus, the resulting particles are very soft and easily deformed by the pressure of press treatment mentioned above, resulting in uniform dispersion of the press pressure on the whole resistor materials mentioned above.

But when the coarse ceramic particles are not contained in the resistor material, coarse glass particles are deformed by the press pressure mentioned above and the force is not well dispersed nor transferred also as to be compressed only in the press pressure direction, which results in curving the boundary surfaces between the resistor and the conducting glass seals.

On the other hand, when the particle size of the coarse glass particles become too large, spaces formed among neighboring coarse glass particles become larger, which results in insufficient filling of the spaces with fine glass particles mentioned below and making a relative resistance change (ΔR) in the initial resistance ($R_0$) after stressing in the spark coil [$\Delta R=(R_1-R_0)/R_0$, wherein $R_1$ is a resistance value after stress in the spark coil] larger than the value specified by JIS D5102. Thus, the upper limit of the particle size of the coarse glass particles is 840 μm. Preferable particle size range of the coarse glass particles is 250 μm to 840 μm.

The particle size of coarse ceramic particles in the ceramic powders is 177 μm to 840 μm as in the case of the coarse glass particles. When the particle size is less than 177 μm, there is a tendency to cause curving of the boundary surfaces. On the other hand, when the particle size is larger than 840 μm, there arises the same problem as mentioned in the case of the coarse glass particles.

The fine glass particles in the glass powders completely melt without retaining particle forms by the heat treatment, and easily move among the resistor material particles at the time of press treatment to drive out the air remaining in a space among coarse glass particles, a space among coarse ceramic particles and a space among coarse glass particles and coarse ceramic particles and to fill the spaces. By this, oxidation of carbon caused by remaining oxygen in the resistor material and damages by burning at the time of electric current application can be reduced to maintain a stable resistance value small in ΔR as mentioned above specified in JIS D5102.

In order to show such an action, the particle size of fine glass particles should be 74 μm or less. When the particle size is 74 μm or less, the softening temperature is 835° C. as shown in FIG. 5. This means that the fine glass particles almost completely melt at the time of heat treatment carried out at 850° C. in general. More preferable particle size of the fine glass particles is 10 μm to 74 μm.

Figure 4A:
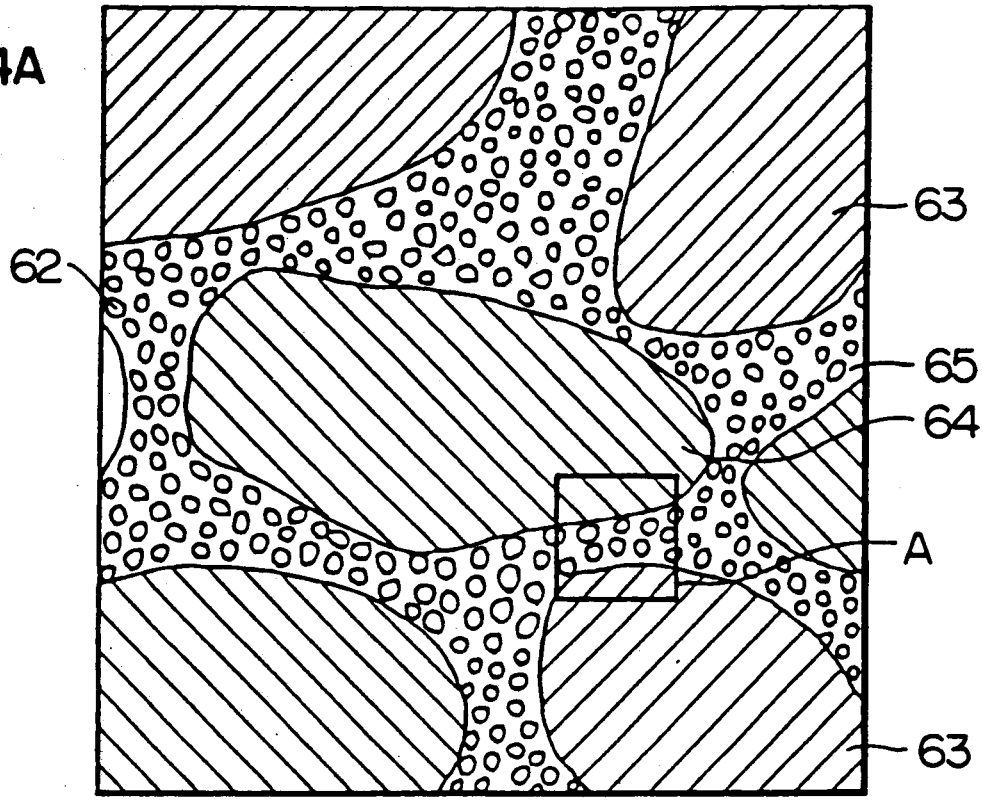
FIGS. 4(*a*) and 4(*b*) are enlarged views showing a structure of resistor and FIG. 4(*b*) is a further enlarged view of the portion A of FIG. 4(*a*).
Figure 4B:
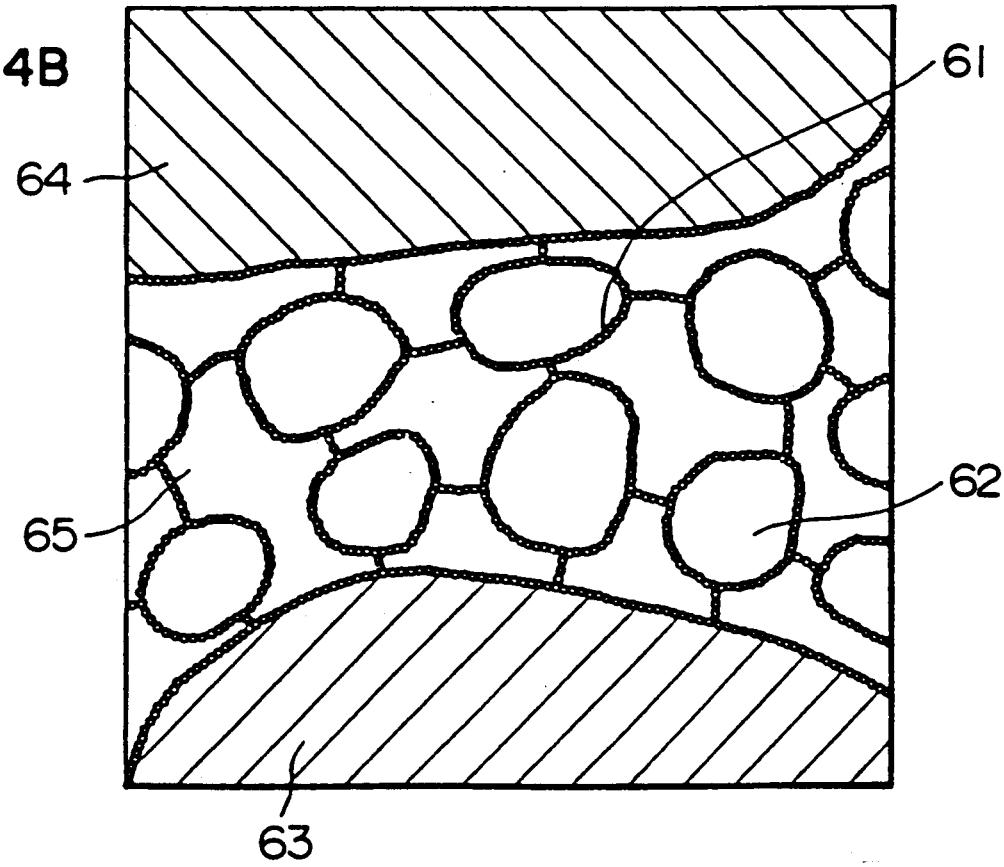

The fine ceramic particles in the ceramic powders function to form electric current passages of carbon black particles 61 in the resistor mentioned below as shown in FIGS. 4(*a*) and 4(*b*). The carbon black particles 61 surround peripheries of fine ceramic particles 62 and contact with carbon black particles 61 each other. As shown in FIG. 4(*b*) which is an enlarged view of the portion A in FIG. 4(*a*), carbon black particles 61 surround not only peripheries of fine ceramic particles 62 but also peripheries of coarse ceramic particles 63 and those of coarse glass particles 64, but, it is the fine ceramic particles 62 that constitute the electric current passages of carbon black mainly. In FIGS. 4(*a*) and 4(*b*), numeral 65 denotes fine glass particles in molten state. Further, since there are many electric current passages of carbon black in the bosom of the resistor by the presence of the fine ceramic particles, the resistance value of the resistor as a whole is hardly influenced even if carbon black is burned out to some extent by remaining oxygen in the resistor.

In order to show such a function, the fine ceramic particles should have a particle size of 10 μm or less, preferably 0.1 μm to 10 μm, which size is available commercially.

Figure 3A:
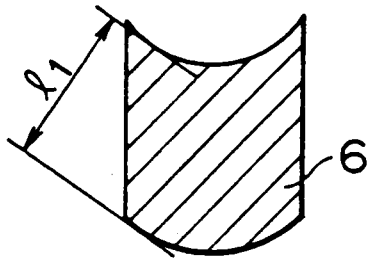
FIGS. 3(*a*) and 3(*b*) are cross-sectional views of resistors for explaining a substantial length of the resistors.
Figure 3B:
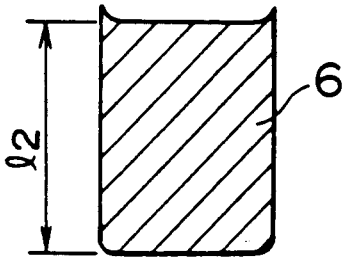

The proportion (weight ratio) of the coarse glass particles in the glass powders is preferably in the range shown by the formulae (3) and (4) or (3') and (4'), the proportion (weight ratio) of the coarse ceramic particles in the ceramic powders is preferably in the range shown by the formulae (5) and (6) or (5') and (6'), and the amount of the glass powders in the mixture of glass powders and ceramic powders is preferably in the range shown by the formulae (1) and (2) or (1') and (2'). By mutual actions of the numeral ranges shown by the formulae (1) to (6) or (1') to (6'), and the particle size ranges of glass powders and ceramic powders, there can be attained the suppression of curving of boundary surfaces of resistors contacting with the conducting glass seals. The substantial length of resistor when curved is "$l_1$" as shown in FIG. 3(*a*) and that of resistor when curving is suppressed is "$l_2$" as shown in FIG. 3(*b*). In FIGS. 3(*a*) and 3(*b*), numeral 6 denotes the resistor.

The amount of carbon black (which is usually in very fine particles) is 0.1 to 2.5% by weight based on 100% by weight of the total of the glass powders and the ceramic powders. Such amounts are necessary for obtaining the resistance value of 0.1 kΩ to 30 kΩ including allowable resistance values specified by JIS D5102.

As mentioned above, according to the present invention, curving of the boundary surfaces of resistor contacting with the conducting glass seals can be suppressed by especially selecting resistor materials, which results in improving the noise signal suppression effect.

The present invention is illustrated by way of the following Examples, in which all percents are by weight unless otherwise specified.

EXAMPLES

Figure 2:
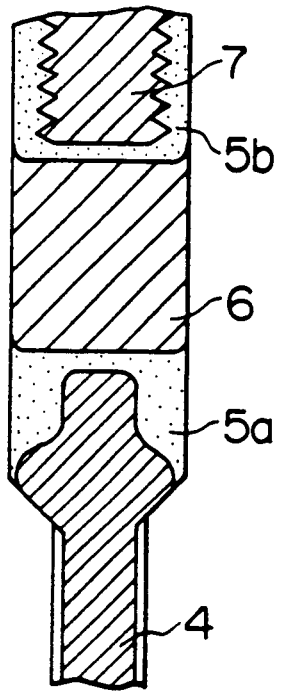
FIG. 2 is an enlarged cross-sectional view of the resistor and conducting glass seals shown in FIG. 1.

One example of the structure of spark plug according to the present invention is explained referring to FIGS. 1 and 2.

An insulator 1 has in its center a bore 8 therethrough in the axis direction. From an opening of one end of the bore 8, a terminal electrode 7 is inserted and from an opening of another end of the bore 8, a center electrode 4 is inserted. In the center portion between the terminal electrode 7 and the center electrode 4, a resistor 6 is placed. A conducting glass seal 5*b* is placed between one end of the resistor 6 and the terminal electrode 7 and a conducting glass seal 5*a* is placed between another end of the resistor 6 and the center electrode 4. These resistor 6 and conducting glass seals 5*a* and 5*b* are bonded together mutually and also bonded to an inner wall of the bore 8 via glass in the materials. The center electrode 4, the terminal electrode 7 are also bonded to the conducting glass seals 5*a* and 5*b*. In FIG. 1, numeral 2 denotes a metal housing and numeral 3 denotes a ground electrode. The structure of resistor 6 is shown typically in FIGS. 4(*a*) and 4(*b*).

A spark plug was produced by the following procedures.

Preparation of Raw Materials for Resistor

A mixture of fine glass particles having a particle size of 74 μm or less, fine ceramic particles having an average particle size (D 50) of 5 μm and carbon black was prepared by mixing in a vibration mill. To this mixture, coarse glass particles having a particle size distribution between 177 μm and 840 μm and coarse ceramic particles having a particle size distribution between 177 μm and 840 μm were added and mixed uniformly using a stirrer. After stirring, 60 g of aqueous solution of 0.65% carboxylmethyl cellulose per kg of the resulting mixture was added for granulating the resulting mixture, followed by sufficient mixing and stirring again. The thus obtained materials for the resistor were dried sufficiently using a dryer and passed through a sieve of 16 mesh (1000 μm).

Particle size distributions of fine glass particles, coarse glass particles and coarse ceramic particle are as shown in the following Tables 2 to 5.

TABLE 2

| Fine glass particles: | |
|---|---|
| Particle Size (μm) | Amount (%) |
| <74 | 0 |
| 53-74 | 18 |
| 37-53 | 33 |
| 25-37 | 30 |
| 25> | 19 |

TABLE 3

| Coarse glass particles: | |
|---|---|
| Particle Size (μm) | Amount (%) |
| <840 | 0 |
| 590-840 | 10 |
| 420-590 | 20 |
| 210-420 | 65 |
| 177-210 | 5 |
| 177> | 0 |

TABLE 4

| Coarse particles of molten Alumina: | |
|---|---|
| Particle size (μm) | Amount (%) |
| <177 | 0 |
| 177-210 | 4 |
| 210-420 | 70 |
| 420-590 | 16 |
| 590-840 | 10 |
| >840 | 0 |

TABLE 5

| Coarse particles of molten silica: | |
|---|---|
| Particle size (μm) | Amount (%) |
| <177 | 0 |
| 177-210 | 8 |
| 210-420 | 75 |
| 420-590 | 10 |
| 590-840 | 7 |
| >840 | 0 |

The glass powders shown in Tables 2 and 3 had the following composition shown in Table 6.

TABLE 6

| Components | $SiO_2$ | $B_2O_3$ | $Al_2O_3$ | CaO | BaO | $Li_2O$ | $Na_2O$ | $K_2O$ |
|---|---|---|---|---|---|---|---|---|
| Amount (%) | 50.0 | 28.5 | 1.0 | 1.0 | 14.2 | 2.8 | 2.4 | 0.1 |

Then, a material for conducting glass seals was prepared by sufficiently mixing 50% of copper powder and 50% of borosilicate glass.

Construction

From the bottom end of a bore (diameter 4.8 mm) of an insulator, a center electrode was inserted and about 0.3 g of the material for conducting glass material was charged into the bore of the insulator, followed by application of press pressure of about 70 kg to make the surface of the material flat. On this, the materials for resistor mentioned above were filled in an amount corresponding to the volume of about 181 $mm^3$, followed by application of press pressure to make the material surface flat. Then, 0.3 g of the same material for conducting glass material as mentioned above was filled on the resistor materials.

After inserting a terminal electrode into the bore of the insulator from the upper end thereof, the insulator was placed in an electric furnace maintained at about 850° C. for about 30 minutes. Then, the insulator was taken out of the furnace and a pressure of about 70 kg was applied to the terminal electrode. After cooling the insulator, it was fixed in a housing having a ground electrode at an outer periphery.

Test method

Figure 6:
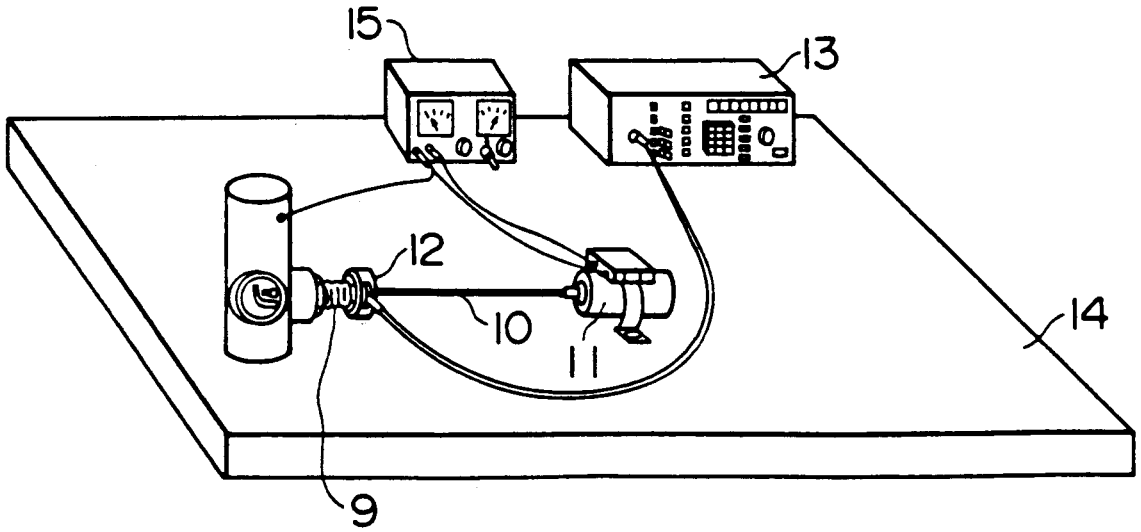
FIG. 6 is a perspective view of a set of apparatus for evaluating properties necessary for explaining the present invention.

Using an apparatus shown in FIG. 6, a noise field intensity of the thus constructed plug was measured. Noise field intensities of the spark plug at measuring frequencies of 30, 90, 180, 300, 500, 800 and 1000 MHz at the time of spark discharge were measured for 60 seconds and employed the maximum value for the evaluation. In FIG. 6, numeral 9 denotes a plug to be tested, numeral 10 a plug cord of 5 Ωk, numeral 11 an ignition coil,, numeral 12 a probe for measuring high frequency current, numeral 13 a field intensity meter, numeral 14 an electrical insulating plate, and numeral 15 a power source.

Evaluation

Spark plugs were produced by using various materials shown in Tables 7 to 16 and evaluated as mentioned above. Resistance values and noise field intensities of the resistors of spark plugs are listed in Tables 7 to 16 in order to show influences thereon of the kinds of coarse ceramic particles and fine ceramic particles, the mixing proportions of glass powders and ceramic powders, the proportions (weight ratios) of coarse glass particles in the glass powders, the proportions (weight ratios) of coarse ceramic particles in the ceramic powders, and the proportions of carbon black.

TABLE 7

| | Glass powders | | | Ceramic powders | | | | Properties | |
|---|---|---|---|---|---|---|---|---|---|
| | | Corse glass particles | | | Corse ceramic particles | | | | |
| Run No. | Amount (%) | Particle size (μm) | Ratio | Amount (%) | Particle size (μm) | Ratio | Carbon black (%) | Resistance value (kΩ) | Noise field intensity (dB) |
| 1 | 66.5 | 177~840 | 0.89 | 33.5 | 177~840 | 0.59 | 1.5 | 6.0 | 65.4 |
| 2 | " | " | 0.86 | " | " | " | 1.3 | 5.5 | 65.6 |
| 3 | " | " | 0.77 | " | " | " | 1.2 | 5.4 | 66.0 |
| 4 | " | " | 0.68 | " | " | " | 1.1 | 4.8 | 66.7 |
| 5 | " | " | 0.63 | " | " | " | 1.0 | 5.0 | 67.3 |
| 6 | 66.5 | " | 0.86 | 33.5 | " | 0.81 | 0.7 | 5.7 | 61.4 |
| 7 | " | " | " | " | " | 0.77 | 0.7 | 5.6 | 62.0 |
| 8 | " | " | " | " | " | 0.49 | 1.4 | 5.2 | 67.3 |
| 9 | " | " | " | " | " | 0.43 | 1.5 | 4.9 | 68.3 |
| 10 | 66.5 | " | 0.68 | 33.5 | " | 0.81 | 0.6 | 5.8 | 62.5 |
| 11 | " | " | " | " | " | 0.77 | 0.7 | 5.3 | 63.1 |
| 12 | " | " | " | " | " | 0.49 | 1.3 | 5.1 | 67.4 |
| 13 | " | " | " | " | " | 0.43 | 1.4 | 5.3 | 68.8 |
| 14 | 56.9 | 177~840 | 0.77 | 43.1 | 177~840 | 0.77 | 0.7 | 5.2 | 63.1 |
| 15 | " | " | " | " | " | 0.73 | 0.9 | 5.1 | 63.8 |
| 16 | " | " | " | " | " | 0.59 | 1.1 | 5.1 | 65.9 |
| 17 | " | " | " | " | " | 0.49 | 1.4 | 5.0 | 67.2 |
| 18 | " | " | " | " | " | 0.43 | 1.7 | 4.7 | 68.6 |
| 19 | 46.8 | " | 0.89 | 53.2 | " | 0.59 | 2.4 | 5.7 | 65.5 |
| 20 | " | " | 0.86 | " | " | " | 2.0 | 5.5 | 66.2 |
| 21 | " | " | 0.77 | " | " | " | 1.6 | 5.7 | 66.7 |
| 22 | " | " | 0.68 | " | " | " | 1.6 | 5.3 | 66.9 |
| 23 | " | " | 0.63 | " | " | " | 1.4 | 5.2 | 67.0 |
| 24 | " | " | 0.86 | 53.2 | " | 0.81 | 1.0 | 6.0 | 62.3 |
| 25 | " | " | " | " | " | 0.77 | 1.3 | 5.8 | 62.9 |
| 26 | " | " | " | " | " | 0.49 | 2.3 | 5.6 | 67.3 |
| 27 | " | " | " | " | " | 0.43 | 2.5 | 5.9 | 68.4 |
| 28 | 46.8 | " | 0.68 | 53.2 | " | 0.81 | 0.7 | 6.2 | 63.5 |
| 29 | " | " | " | " | " | 0.77 | 0.9 | 5.6 | 64.2 |
| 30 | " | " | " | " | " | 0.49 | 1.7 | 5.7 | 67.2 |
| 31 | " | " | " | " | " | 0.43 | 1.8 | 5.9 | 68.9 |
| 32 | 56.9 | " | 0.77 | 43.1 | " | 0.73 | 0.1 | 31.2 | 55.7 |
| 33 | " | " | " | " | " | " | 0.7 | 10.7 | 58.5 |
| 34 | " | " | " | " | " | " | 1.8 | 1.4 | 68.6 |
| 35 | " | " | " | " | " | " | 3.1 | 0.1 | 82.6 |
| 36 | 80 | 177~840 | 0.9 | 20 | — | 0 | 0.08 | 30.0 | 58.9 |
| 37 | " | " | " | " | — | 0 | 0.5 | 10.0 | 59.4 |
| 38 | " | " | " | " | — | 0 | 0.9 | 5.0 | 67.6 |
| 39 | " | " | " | " | — | 0 | 1.4 | 1.0 | 70.3 |
| 40 | " | " | " | " | — | 0 | 2.7 | 0.1 | 85.2 |

Coarse ceramic particles: molten alumina
Fine ceramic particles: silicon nitride

TABLE 8

| | Glass powders | | | Ceramic powders | | | | Properties | |
|---|---|---|---|---|---|---|---|---|---|
| | | Corse glass particles | | | Corse ceramic particles | | | | |
| Run No. | Amount (%) | Particle size (μm) | Ratio | Amount (%) | Particle size (μm) | Ratio | Carbon black (%) | Resistance value (kΩ) | Noise field intensity (dB) |
| 1 | 60 | 177~840 | 0.99 | 40 | 177~840 | 0.45 | 1.4 | 5.9 | 65.2 |
| 2 | " | " | 0.95 | " | " | " | 1.2 | 5.4 | 65.5 |
| 3 | " | " | 0.85 | " | " | " | 1.1 | 5.3 | 65.9 |

TABLE 8-continued

| Run No. | Glass powders Amount (%) | Corse glass particles Particle size (μm) | Corse glass particles Ratio | Ceramic powders Amount (%) | Corse ceramic particles Particle size (μm) | Corse ceramic particles Ratio | Carbon black (%) | Properties Resistance value (kΩ) | Properties Noise field intensity (dB) |
|---|---|---|---|---|---|---|---|---|---|
| 4 | " | " | 0.75 | " | " | " | 1.0 | 4.7 | 66.4 |
| 5 | " | " | 0.7 | " | " | " | 0.9 | 4.9 | 67.3 |
| 6 | 60 | " | 0.95 | 40 | " | 0.7 | 0.7 | 5.7 | 61.4 |
| 7 | " | " | " | " | " | 0.65 | 0.7 | 5.5 | 62.0 |
| 8 | " | " | " | " | " | 0.35 | 1.4 | 5.2 | 67.2 |
| 9 | " | " | " | " | " | 0.3 | 1.5 | 4.8 | 68.1 |
| 10 | 60 | " | 0.75 | 40 | " | 0.7 | 0.6 | 5.7 | 62.7 |
| 11 | " | " | " | " | " | 0.65 | 0.6 | 5.2 | 63.3 |
| 12 | " | " | " | " | " | 0.35 | 1.2 | 5.0 | 67.4 |
| 13 | " | " | " | " | " | 0.3 | 1.3 | 5.3 | 68.6 |
| 14 | 50 | 177~840 | 0.85 | 50 | 177~840 | 0.65 | 0.8 | 5.4 | 63.0 |
| 15 | " | " | " | " | " | 0.6 | 1.0 | 5.1 | 64.0 |
| 16 | " | " | " | " | " | 0.45 | 1.2 | 5.2 | 65.8 |
| 17 | " | " | " | " | " | 0.35 | 1.5 | 5.1 | 67.5 |
| 18 | " | " | " | " | " | 0.3 | 1.8 | 4.9 | 68.6 |
| 19 | 40 | " | 0.99 | 60 | " | 0.45 | 2.3 | 5.5 | 65.7 |
| 20 | " | " | 0.95 | " | " | " | 1.9 | 5.4 | 66.1 |
| 21 | " | " | 0.85 | " | " | " | 1.6 | 5.7 | 66.6 |
| 22 | " | " | 0.75 | " | " | " | 1.5 | 5.2 | 66.8 |
| 23 | " | " | 0.7 | " | " | " | 1.3 | 5.2 | 67.0 |
| 24 | 40 | " | 0.95 | 60 | " | 0.7 | 0.9 | 6.0 | 62.3 |
| 25 | " | " | " | " | " | 0.65 | 1.2 | 5.7 | 62.8 |
| 26 | " | " | " | " | " | 0.35 | 2.2 | 5.5 | 67.1 |
| 27 | " | " | " | " | " | 0.3 | 2.4 | 5.8 | 68.3 |
| 28 | 40 | " | 0.75 | 60 | " | 0.7 | 0.8 | 6.2 | 63.5 |
| 29 | " | " | " | " | " | 0.65 | 1.0 | 5.5 | 64.2 |
| 30 | " | " | " | " | " | 0.35 | 1.8 | 5.6 | 67.4 |
| 31 | " | " | " | " | " | 0.3 | 1.9 | 5.9 | 68.9 |
| 32 | 50 | " | 0.85 | 50 | " | 0.6 | 0.1 | 31.2 | 55.5 |
| 33 | " | " | " | " | " | " | 0.6 | 10.7 | 58.3 |
| 34 | " | " | " | " | " | " | 1.7 | 1.3 | 68.7 |
| 35 | " | " | " | " | " | " | 3.0 | 0.1 | 82.8 |
| 36 | 80 | 177~840 | 0.9 | 20 | — | 0 | 0.08 | 30.0 | 58.9 |
| 37 | " | " | " | " | — | 0 | 0.5 | 10.0 | 59.4 |
| 38 | " | " | " | " | — | 0 | 0.9 | 5.0 | 67.6 |
| 39 | " | " | " | " | — | 0 | 1.4 | 1.0 | 70.3 |
| 40 | " | " | " | " | — | 0 | 2.7 | 0.1 | 85.2 |

Coarse ceramic particles: molten alumina
Fine ceramic particles: $ZrO_2$

TABLE 9

| Run No. | Glass powders Amount (%) | Corse glass particles Particle size (μm) | Corse glass particles Ratio | Ceramic powders Amount (%) | Corse ceramic particles Particle size (μm) | Corse ceramic particles Ratio | Carbon black (%) | Properties Resistance value (kΩ) | Properties Noise field intensity (dB) |
|---|---|---|---|---|---|---|---|---|---|
| 1 | 64 | 177~840 | 0.92 | 36 | 177~840 | 0.54 | 1.3 | 6.0 | 65.3 |
| 2 | " | " | 0.88 | " | " | " | 1.1 | 5.5 | 65.6 |
| 3 | " | " | 0.78 | " | " | " | 1.0 | 5.4 | 66.0 |
| 4 | " | " | 0.69 | " | " | " | 0.9 | 4.8 | 66.5 |
| 5 | " | " | 0.65 | " | " | " | 0.8 | 5.0 | 67.4 |
| 6 | 64 | " | 0.88 | 36 | " | 0.77 | 0.7 | 5.7 | 61.2 |
| 7 | " | " | " | " | " | 0.73 | 0.7 | 5.5 | 61.8 |
| 8 | " | " | " | " | " | 0.44 | 1.4 | 5.2 | 67.0 |
| 9 | " | " | " | " | " | 0.38 | 1.5 | 4.8 | 67.9 |
| 10 | 64 | " | 0.69 | 36 | " | 0.77 | 0.7 | 5.6 | 63.0 |
| 11 | " | " | " | " | " | 0.73 | 0.7 | 5.1 | 63.6 |
| 12 | " | " | " | " | " | 0.44 | 1.3 | 4.9 | 67.7 |
| 13 | " | " | " | " | " | 0.38 | 1.4 | 5.2 | 68.9 |
| 14 | 54 | 177~840 | 0.78 | 46 | 177~840 | 0.73 | 0.9 | 5.5 | 62.6 |
| 15 | " | " | " | " | " | 0.69 | 1.1 | 5.2 | 63.6 |
| 16 | " | " | " | " | " | 0.54 | 1.3 | 5.3 | 65.5 |
| 17 | " | " | " | " | " | 0.44 | 1.6 | 5.2 | 67.2 |
| 18 | " | " | " | " | " | 0.38 | 1.9 | 5.0 | 68.3 |
| 19 | 44 | " | 0.92 | 56 | " | 0.54 | 2.2 | 5.4 | 65.7 |
| 20 | " | " | 0.88 | " | " | " | 1.8 | 5.3 | 66.2 |
| 21 | " | " | 0.78 | " | " | " | 1.5 | 5.6 | 66.4 |
| 22 | " | " | 0.69 | " | " | " | 1.4 | 5.1 | 66.8 |
| 23 | " | " | 0.65 | " | " | " | 1.2 | 5.1 | 67.2 |
| 24 | 44 | " | 0.88 | 56 | " | 0.77 | 0.9 | 6.0 | 62.1 |
| 25 | " | " | " | " | " | 0.73 | 1.2 | 5.7 | 63.0 |
| 26 | " | " | " | " | " | 0.44 | 2.2 | 5.5 | 67.1 |
| 27 | " | " | " | " | " | 0.38 | 2.4 | 5.8 | 68.5 |

TABLE 9-continued

| Run No. | Glass powders Amount (%) | Corse glass particles Particle size (μm) | Corse glass particles Ratio | Ceramic powders Amount (%) | Corse ceramic particles Particle size (μm) | Corse ceramic particles Ratio | Carbon black (%) | Properties Resistance value (kΩ) | Properties Noise field intensity (dB) |
|---|---|---|---|---|---|---|---|---|---|
| 28 | 44 | " | 0.69 | 56 | " | 0.77 | 0.9 | 6.1 | 63.5 |
| 29 | " | " | " | " | " | 0.73 | 1.1 | 5.4 | 64.4 |
| 30 | " | " | " | " | " | 0.44 | 1.9 | 5.5 | 67.8 |
| 31 | " | " | " | " | " | 0.38 | 2.0 | 5.8 | 68.2 |
| 32 | 54 | " | 0.78 | 46 | " | 0.69 | 0.2 | 27.5 | 55.4 |
| 33 | " | " | " | " | " | " | 0.7 | 9.3 | 58.4 |
| 34 | " | " | " | " | " | " | 1.8 | 0.9 | 68.6 |
| 35 | " | " | " | " | " | " | 3.1 | 0.1 | 82.9 |
| 36 | 80 | 177~840 | 0.9 | 20 | — | — | 0.08 | 30.0 | 58.9 |
| 37 | " | " | " | " | — | — | 0.5 | 10.0 | 59.4 |
| 38 | " | " | " | " | — | — | 0.9 | 5.0 | 67.6 |
| 39 | " | " | " | " | — | — | 1.4 | 1.0 | 70.3 |
| 40 | " | " | " | " | — | — | 2.7 | 0.1 | 85.2 |

Coarse ceramic particles: molten alumina
Fine ceramic particles: alumina

TABLE 10

Coarse ceramic particles: molten alumina
Fine ceramic particles: zircon

| Run No. | Glass powders Amount (%) | Coarse glass particles Particle size (μm) | Coarse glass particles Ratio | Ceramic powders Amount (%) | Coarse ceramic particles Particle size (μm) | Coarse ceramic particles Ratio | Carbon black (%) | Properties Resistance value (kΩ) | Properties Noise field intensity (dB) |
|---|---|---|---|---|---|---|---|---|---|
| 1 | 62.7 | 177~840 | 0.95 | 37.3 | 177~840 | 0.51 | 1.4 | 6.0 | 65.4 |
| 2 | " | " | 0.91 | " | " | " | 1.3 | 5.8 | 65.6 |
| 3 | " | " | 0.81 | " | " | " | 1.1 | 5.6 | 66.1 |
| 4 | " | " | 0.72 | " | " | " | 0.9 | 5.7 | 66.5 |
| 5 | " | " | 0.67 | " | " | " | 0.8 | 5.5 | 67.6 |
| 6 | 62.7 | " | 0.91 | 37.3 | " | 0.74 | 0.7 | 5.7 | 62.1 |
| 7 | " | " | " | " | " | 0.70 | 0.7 | 6.2 | 63.5 |
| 8 | " | " | " | " | " | 0.40 | 1.3 | 5.6 | 67.0 |
| 9 | " | " | " | " | " | 0.35 | 1.4 | 5.5 | 68.3 |
| 10 | 62.7 | " | 0.72 | 37.3 | " | 0.74 | 0.6 | 5.9 | 62.5 |
| 11 | " | " | " | " | " | 0.70 | 0.6 | 5.5 | 63.8 |
| 12 | " | " | " | " | " | 0.40 | 1.1 | 5.7 | 67.2 |
| 13 | " | " | " | " | " | 0.35 | 1.2 | 5.3 | 68.7 |
| 14 | 52.9 | 177~840 | 0.81 | 47.1 | 177~840 | 0.70 | 0.8 | 5.2 | 62.9 |
| 15 | " | " | " | " | " | 0.65 | 1.0 | 5.4 | 63.8 |
| 16 | " | " | " | " | " | 0.51 | 1.2 | 5.1 | 65.4 |
| 17 | " | " | " | " | " | 0.40 | 1.4 | 5.4 | 67.3 |
| 18 | " | " | " | " | " | 0.35 | 1.6 | 5.3 | 68.9 |
| 19 | 42.8 | " | 0.95 | 57.2 | " | 0.51 | 2.1 | 5.9 | 65.6 |
| 20 | " | " | 0.91 | " | " | " | 1.7 | 5.7 | 66.2 |
| 21 | " | " | 0.81 | " | " | " | 1.5 | 5.5 | 66.5 |
| 22 | " | " | 0.72 | " | " | " | 1.3 | 5.6 | 66.9 |
| 23 | " | " | 0.67 | " | " | " | 1.1 | 5.4 | 67.0 |
| 24 | 42.8 | " | 0.91 | 57.2 | " | 0.74 | 0.9 | 5.8 | 62.5 |
| 25 | " | " | " | " | " | 0.70 | 1.2 | 5.6 | 63.3 |
| 26 | " | " | " | " | " | 0.40 | 2.2 | 5.5 | 67.0 |
| 27 | " | " | " | " | " | 0.35 | 2.4 | 5.0 | 68.6 |
| 28 | 42.8 | " | 0.72 | 57.2 | " | 0.74 | 0.8 | 5.9 | 63.7 |
| 29 | " | " | " | " | " | 0.70 | 1.0 | 5.7 | 64.4 |
| 30 | " | " | " | " | " | 0.40 | 1.8 | 5.7 | 67.2 |
| 31 | " | " | " | " | " | 0.35 | 2.0 | 5.8 | 68.5 |
| 32 | 52.9 | " | 0.81 | 47.1 | " | 0.65 | 0.1 | 29.5 | 56.8 |
| 33 | " | " | " | " | " | " | 0.5 | 12.3 | 58.9 |
| 34 | " | " | " | " | " | " | 1.5 | 1.8 | 68.5 |
| 35 | " | " | " | " | " | " | 3.0 | 0.1 | 83.0 |
| 36 | 80 | 177~840 | 0.9 | 20 | 177~840 | 0 | 0.08 | 30.0 | 58.9 |
| 37 | " | " | " | " | " | 0 | 0.5 | 10.0 | 59.4 |
| 38 | " | " | " | " | " | 0 | 0.9 | 5.0 | 67.6 |
| 39 | " | " | " | " | " | 0 | 1.4 | 1.0 | 70.3 |
| 40 | " | " | " | " | " | 0 | 2.7 | 0.1 | 85.2 |

TABLE 11

| | Coarse ceramic particles: molten alumina Fine ceramic particles: silica | | | | | | | | |
|---|---|---|---|---|---|---|---|---|---|
| | Glass powders | | | Ceramic powders | | | | Properties | |
| | | Coarse glass particles | | | Coarse ceramic particles | | | | |
| Run No. | Amount (%) | Particle size (μm) | Ratio | Amount (%) | Particle size (μm) | Ratio | Carbon black (%) | Resistance value (kΩ) | Noise field intensity (dB) |
| 1 | 69.2 | 177~840 | 0.86 | 330.8 | 177~840 | 0.67 | 1.3 | 5.7 | 65.3 |
| 2 | " | " | 0.82 | " | " | " | 1.3 | 5.1 | 65.4 |
| 3 | " | " | 0.74 | " | " | " | 1.1 | 4.8 | 66.1 |
| 4 | " | " | 0.65 | " | " | " | 0.9 | 4.6 | 67.2 |
| 5 | " | " | 0.61 | " | " | " | 0.9 | 4.8 | 67.7 |
| 6 | 69.2 | " | 0.82 | 30.8 | " | 0.85 | 0.8 | 5.6 | 61.6 |
| 7 | " | " | " | " | " | 0.82 | 0.8 | 5.8 | 62.5 |
| 8 | " | " | " | " | " | 0.58 | 1.3 | 5.0 | 67.0 |
| 9 | " | " | " | " | " | 0.52 | 1.4 | 5.3 | 67.9 |
| 10 | 69.2 | " | 0.65 | 30.8 | " | 0.85 | 0.5 | 6.1 | 62.8 |
| 11 | " | " | " | " | " | 0.82 | 0.6 | 5.4 | 63.3 |
| 12 | " | " | " | " | " | 0.58 | 1.1 | 5.3 | 67.1 |
| 13 | " | " | " | " | " | 0.52 | 1.2 | 5.5 | 68.6 |
| 14 | 60.0 | 177~840 | 0.74 | 42.0 | 177~840 | 0.82 | 0.8 | 5.1 | 63.3 |
| 15 | " | " | " | " | " | 0.79 | 1.0 | 5.0 | 64.1 |
| 16 | " | " | " | " | " | 0.67 | 1.2 | 5.3 | 65.4 |
| 17 | " | " | " | " | " | 0.58 | 1.5 | 5.0 | 67.4 |
| 18 | " | " | " | " | " | 0.52 | 1.8 | 5.1 | 68.8 |
| 19 | 50.0 | " | 0.86 | 50.0 | " | 0.67 | 2.2 | 5.4 | 65.2 |
| 20 | " | " | 0.82 | " | " | " | 1.9 | 5.4 | 66.5 |
| 21 | " | " | 0.74 | " | " | " | 1.6 | 5.6 | 66.7 |
| 22 | " | " | 0.65 | " | " | " | 1.5 | 5.2 | 66.9 |
| 23 | " | " | 0.61 | " | " | " | 1.3 | 5.3 | 67.3 |
| 24 | 50.0 | " | 0.82 | 50.0 | " | 0.85 | 1.0 | 5.6 | 62.5 |
| 25 | " | " | " | " | " | 0.82 | 1.2 | 5.4 | 63.2 |
| 26 | " | " | " | " | " | 0.58 | 2.2 | 5.3 | 67.0 |
| 27 | " | " | " | " | " | 0.52 | 2.4 | 5.7 | 68.8 |
| 28 | 50.0 | " | 0.65 | 50.0 | " | 0.85 | 0.8 | 6.3 | 63.3 |
| 29 | " | " | " | " | " | 0.82 | 1.0 | 5.5 | 64.5 |
| 30 | " | " | " | " | " | 0.58 | 1.8 | 5.1 | 67.1 |
| 31 | " | " | " | " | " | 0.52 | 1.8 | 5.6 | 69.0 |
| 32 | 60.0 | " | 0.74 | 40.0 | " | 0.79 | 0.1 | 30.4 | 55.7 |
| 33 | " | " | " | " | " | " | 0.7 | 9.8 | 57.8 |
| 34 | " | " | " | " | " | " | 1.7 | 1.2 | 68.4 |
| 35 | " | " | " | " | " | " | 3.0 | 0.1 | 82.9 |
| 36 | 80 | 177~840 | 0.9 | 20 | — | 0 | 0.08 | 30.0 | 58.9 |
| 37 | " | " | " | " | — | 0 | 0.5 | 10.0 | 59.4 |
| 38 | " | " | " | " | — | 0 | 0.9 | 5.0 | 67.6 |
| 39 | " | " | " | " | — | 0 | 1.4 | 1.0 | 70.3 |
| 40 | " | " | " | " | — | 0 | 2.7 | 0.1 | 85.2 |

TABLE 12

| | Coarse ceramic particles: molten silica Fine ceramic particles: $Si_3N_4$ | | | | | | | | |
|---|---|---|---|---|---|---|---|---|---|
| | Glass powders | | | Ceramic powders | | | | Properties | |
| | | Coarse glass particles | | | Coarse ceramic particles | | | | |
| Run No. | Amount (%) | Particle size (μm) | Ratio | Amount (%) | Particle size (μm) | Ratio | Carbon black (%) | Resistance value (kΩ) | Noise field intensity (dB) |
| 1 | 72.6 | 177~840 | 0.82 | 27.4 | 177~840 | 0.45 | 1.5 | 6.1 | 65.2 |
| 2 | " | " | 0.79 | " | " | " | 1.3 | 5.5 | 65.9 |
| 3 | " | " | 0.71 | " | " | " | 1.2 | 5.3 | 66.4 |
| 4 | " | " | 0.62 | " | " | " | 1.1 | 4.9 | 66.9 |
| 5 | " | " | 0.58 | " | " | " | 1.0 | 5.1 | 67.2 |
| 6 | 72.6 | " | 0.79 | 27.4 | " | 0.71 | 0.7 | 5.7 | 61.0 |
| 7 | " | " | " | " | " | 0.66 | 0.7 | 5.6 | 62.1 |
| 8 | " | " | " | " | " | 0.36 | 1.4 | 5.3 | 67.4 |
| 9 | " | " | " | " | " | 0.30 | 1.5 | 4.9 | 68.6 |
| 10 | 72.6 | " | 0.62 | 27.4 | " | 0.71 | 0.6 | 5.6 | 62.5 |
| 11 | " | " | " | " | " | 0.66 | 0.7 | 5.4 | 63.2 |
| 12 | " | " | " | " | " | 0.36 | 1.3 | 5.2 | 67.3 |
| 13 | " | " | " | " | " | 0.30 | 1.4 | 5.5 | 68.7 |
| 14 | 63.7 | 177~840 | 0.71 | 36.3 | 177~840 | 0.66 | 0.7 | 5.6 | 63.3 |
| 15 | " | " | " | " | " | 0.61 | 0.9 | 5.2 | 63.6 |
| 16 | " | " | " | " | " | 0.45 | 1.1 | 5.2 | 66.0 |
| 17 | " | " | " | " | " | 0.36 | 1.4 | 5.0 | 67.0 |
| 18 | " | " | " | " | " | 0.30 | 1.7 | 4.8 | 68.9 |
| 19 | 53.9 | " | 0.82 | 46.1 | " | 0.45 | 2.4 | 5.7 | 65.6 |
| 20 | " | " | 0.79 | " | " | " | 2.0 | 5.5 | 66.2 |
| 21 | " | " | 0.71 | " | " | " | 1.6 | 5.3 | 66.8 |

TABLE 12-continued

| | Coarse ceramic particles: molten silica Fine ceramic particles: $Si_3N_4$ | | | | | | | | |
|---|---|---|---|---|---|---|---|---|---|
| | Glass powders | | | Ceramic powders | | | | Properties | |
| | | Coarse glass particles | | | Coarse ceramic particles | | | | |
| Run No. | Amount (%) | Particle size (μm) | Ratio | Amount (%) | Particle size (μm) | Ratio | Carbon black (%) | Resistance value (kΩ) | Noise field intensity (dB) |
| 22 | " | " | 0.62 | " | " | " | 1.6 | 5.4 | 67.2 |
| 23 | " | " | 0.58 | " | " | " | 1.4 | 5.2 | 67.4 |
| 24 | 53.9 | " | 0.79 | 46.1 | " | 0.71 | 1.0 | 6.1 | 62.0 |
| 25 | " | " | " | " | " | 0.66 | 1.3 | 5.7 | 62.7 |
| 26 | " | " | " | " | " | 0.36 | 2.3 | 5.7 | 67.0 |
| 27 | " | " | " | " | " | 0.30 | 2.5 | 5.4 | 68.5 |
| 28 | 53.9 | " | 0.62 | 46.1 | " | 0.71 | 0.7 | 6.0 | 63.1 |
| 29 | " | " | " | " | " | 0.66 | 0.9 | 5.3 | 64.3 |
| 30 | " | " | " | " | " | 0.36 | 1.7 | 5.4 | 67.1 |
| 31 | " | " | " | " | " | 0.30 | 1.8 | 5.6 | 67.9 |
| 32 | 63.7 | " | 0.71 | 36.3 | " | 0.61 | 0.1 | 33.3 | 55.0 |
| 33 | " | " | " | " | " | " | 0.7 | 11.5 | 58.2 |
| 34 | " | " | " | " | " | " | 1.8 | 1.8 | 68.4 |
| 35 | " | " | " | " | " | " | 3.1 | 0.1 | 81.8 |
| 36 | 80.0 | 177~840 | 0.9 | 20.0 | — | 0 | 0.08 | 30.0 | 58.9 |
| 37 | " | " | " | " | — | 0 | 0.5 | 10.0 | 59.4 |
| 38 | " | " | " | " | — | 0 | 0.9 | 5.0 | 57.6 |
| 39 | " | " | " | " | — | 0 | 1.4 | 1.0 | 70.3 |
| 40 | " | " | " | " | — | 0 | 2.7 | 0.1 | 85.2 |

TABLE 13

| | Coarse ceramic particles: molten silica Fine ceramic particles: $ZrO_2$ | | | | | | | | |
|---|---|---|---|---|---|---|---|---|---|
| | Glass powders | | | Ceramic powders | | | | Properties | |
| | | Coarse glass particles | | | Coarse ceramic particles | | | | |
| Run No. | Amount (%) | Particle size (μm) | Ratio | Amount (%) | Particle size (μm) | Ratio | Carbon black (%) | Resistance value (kΩ) | Noise field intensity (dB) |
| 1 | 64.9 | 177~840 | 0.92 | 35.1 | 177~840 | 0.32 | 1.4 | 5.8 | 65.1 |
| 2 | " | " | 0.88 | " | " | " | 1.2 | 5.3 | 65.4 |
| 3 | " | " | 0.79 | " | " | " | 1.1 | 5.2 | 65.7 |
| 4 | " | " | 0.69 | " | " | " | 1.0 | 4.6 | 66.2 |
| 5 | " | " | 0.65 | " | " | " | 0.9 | 4.8 | 67.2 |
| 6 | 64.9 | " | 0.88 | 35.1 | " | 0.57 | 0.7 | 5.6 | 61.3 |
| 7 | " | " | " | " | " | 0.50 | 0.7 | 5.4 | 62.3 |
| 8 | " | " | " | " | " | 0.24 | 1.4 | 5.1 | 67.2 |
| 9 | " | " | " | " | " | 0.20 | 1.5 | 4.7 | 68.1 |
| 10 | 64.9 | " | 0.69 | 35.1 | " | 0.57 | 0.6 | 5.6 | 62.5 |
| 11 | " | " | " | " | " | 0.50 | 0.6 | 5.1 | 63.6 |
| 12 | " | " | " | " | " | 0.24 | 1.2 | 4.9 | 67.2 |
| 13 | " | " | " | " | " | 0.20 | 1.3 | 5.2 | 68.9 |
| 14 | 55.2 | 177~840 | 0.79 | 44.8 | 177~840 | 0.50 | 0.8 | 5.3 | 63.1 |
| 15 | " | " | " | " | " | 0.46 | 1.0 | 5.0 | 64.3 |
| 16 | " | " | " | " | " | 0.32 | 1.2 | 5.1 | 65.8 |
| 17 | " | " | " | " | " | 0.24 | 1.5 | 5.0 | 67.4 |
| 18 | " | " | " | " | " | 0.20 | 1.8 | 4.8 | 68.7 |
| 19 | 45.1 | " | 0.92 | 54.9 | " | 0.32 | 2.3 | 5.4 | 65.5 |
| 20 | " | " | 0.88 | " | " | " | 1.9 | 5.3 | 66.4 |
| 21 | " | " | 0.79 | " | " | " | 1.6 | 5.6 | 66.8 |
| 22 | " | " | 0.69 | " | " | " | 1.5 | 5.1 | 67.0 |
| 23 | " | " | 0.65 | " | " | " | 1.3 | 5.1 | 67.9 |
| 24 | 45.1 | " | 0.88 | 54.9 | " | 0.57 | 0.9 | 6.2 | 62.1 |
| 25 | " | " | " | " | " | 0.50 | 1.2 | 5.9 | 62.6 |
| 26 | " | " | " | " | " | 0.24 | 2.2 | 5.7 | 67.0 |
| 27 | " | " | " | " | " | 0.20 | 2.4 | 6.0 | 68.1 |
| 28 | 45.1 | " | 0.69 | 54.9 | " | 0.57 | 0.8 | 6.1 | 63.3 |
| 29 | " | " | " | " | " | 0.50 | 1.0 | 5.4 | 64.0 |
| 30 | " | " | " | " | " | 0.24 | 1.8 | 5.5 | 67.1 |
| 31 | " | " | " | " | " | 0.20 | 1.9 | 5.7 | 68.8 |
| 32 | 55.2 | " | 0.79 | 44.8 | " | 0.46 | 0.1 | 30.7 | 55.3 |
| 33 | " | " | " | " | " | " | 0.6 | 11.1 | 58.2 |
| 34 | " | " | " | " | " | " | 1.7 | 1.4 | 68.7 |
| 35 | " | " | " | " | " | " | 3.0 | 0.1 | 83.4 |
| 36 | 80 | 177~840 | 0.9 | 20 | — | 0 | 0.08 | 30.0 | 58.9 |
| 37 | " | " | " | " | — | 0 | 0.5 | 10.0 | 59.4 |
| 38 | " | " | " | " | — | 0 | 0.9 | 5.0 | 67.6 |
| 39 | " | " | " | " | — | 0 | 1.4 | 1.0 | 70.3 |
| 40 | " | " | " | " | — | 0 | 2.7 | 0.1 | 85.2 |

TABLE 14

| | Coarse ceramic particles: molten silica<br>Fine ceramic particles: Alumina | | | | | | | | |
|---|---|---|---|---|---|---|---|---|---|
| | Glass powders | | | Ceramic powders | | | | Properties | |
| | | Coarse glass particles | | | Coarse ceramic particles | | | | |
| Run No. | Amount (%) | Particle size (μm) | Ratio | Amount (%) | Particle size (μm) | Ratio | Carbon black (%) | Resistance value (kΩ) | Noise field intensity (dB) |
| 1 | 69.7 | 177~840 | 0.85 | 30.3 | 177~840 | 0.40 | 1.3 | 6.2 | 65.0 |
| 2 | " | " | 0.81 | " | " | " | 1.1 | 5.8 | 65.3 |
| 3 | " | " | 0.72 | " | " | " | 1.0 | 5.6 | 66.1 |
| 4 | " | " | 0.63 | " | " | " | 0.9 | 5.0 | 66.4 |
| 5 | " | " | 0.60 | " | " | " | 0.8 | 5.1 | 67.6 |
| 6 | 69.7 | " | 0.81 | 30.3 | " | 0.65 | 0.7 | 5.9 | 61.0 |
| 7 | " | " | " | " | " | 0.61 | 0.7 | 5.5 | 61.7 |
| 8 | " | " | " | " | " | 0.31 | 1.4 | 5.4 | 66.8 |
| 9 | " | " | " | " | " | 0.23 | 1.5 | 5.0 | 67.9 |
| 10 | 69.7 | " | 0.63 | 30.3 | " | 0.65 | 0.7 | 5.8 | 62.9 |
| 11 | " | " | " | " | " | 0.61 | 0.7 | 5.2 | 63.5 |
| 12 | " | " | " | " | " | 0.31 | 1.3 | 5.1 | 67.2 |
| 13 | " | " | " | " | " | 0.23 | 1.4 | 5.3 | 68.3 |
| 14 | 60.0 | 177~840 | 0.72 | 40.0 | 177~840 | 0.61 | 0.9 | 5.6 | 62.8 |
| 15 | " | " | " | " | " | 0.56 | 1.1 | 5.5 | 63.5 |
| 16 | " | " | " | " | " | 0.40 | 1.3 | 5.5 | 65.7 |
| 17 | " | " | " | " | " | 0.31 | 1.6 | 5.2 | 66.9 |
| 18 | " | " | " | " | " | 0.23 | 1.9 | 5.0 | 68.0 |
| 19 | 50.4 | " | 0.85 | 49.6 | " | 0.40 | 2.2 | 5.6 | 65.2 |
| 20 | " | " | 0.81 | " | " | " | 1.8 | 5.5 | 65.8 |
| 21 | " | " | 0.72 | " | " | " | 1.5 | 5.7 | 66.3 |
| 22 | " | " | 0.63 | " | " | " | 1.4 | 5.3 | 67.0 |
| 23 | " | " | 0.60 | " | " | " | 1.2 | 5.4 | 67.4 |
| 24 | 50.4 | " | 0.81 | 49.6 | " | 0.65 | 0.9 | 6.1 | 62.3 |
| 25 | " | " | " | " | " | 0.61 | 1.2 | 5.9 | 63.1 |
| 26 | " | " | " | " | " | 0.31 | 2.2 | 5.7 | 67.2 |
| 27 | " | " | " | " | " | 0.23 | 2.4 | 5.7 | 68.0 |
| 28 | 50.4 | " | 0.63 | 49.6 | " | 0.65 | 0.9 | 6.0 | 63.2 |
| 29 | " | " | " | " | " | 0.61 | 1.1 | 5.6 | 64.5 |
| 30 | " | " | " | " | " | 0.31 | 1.9 | 5.4 | 67.0 |
| 31 | " | " | " | " | " | 0.23 | 2.0 | 5.8 | 68.1 |
| 32 | 60.0 | " | 0.72 | 40.0 | " | 0.56 | 0.2 | 29.1 | 55.0 |
| 33 | " | " | " | " | " | " | 0.7 | 9.2 | 58.1 |
| 34 | " | " | " | " | " | " | 1.8 | 0.8 | 68.9 |
| 35 | " | " | " | " | " | " | 3.1 | 0.1 | 83.2 |
| 36 | 80.0 | 177~840 | 0.9 | 20.0 | — | 0 | 0.08 | 30.0 | 58.9 |
| 37 | " | " | " | " | — | 0 | 0.5 | 10.0 | 59.4 |
| 38 | " | " | " | " | — | 0 | 0.9 | 5.0 | 67.6 |
| 39 | " | " | " | " | — | 0 | 1.4 | 1.0 | 70.3 |
| 40 | " | " | " | " | — | 0 | 2.7 | 0.1 | 85.2 |

TABLE 15

| | Coarse ceramic particles: molten silica<br>Fine ceramic particles: zircon | | | | | | | | |
|---|---|---|---|---|---|---|---|---|---|
| | Glass powders | | | Ceramic powders | | | | Properties | |
| | | Coarse glass particles | | | Coarse ceramic particles | | | | |
| Run No. | Amount (%) | Particle size (μm) | Ratio | Amount (%) | Particle size (μm) | Ratio | Carbon black (%) | Resistance value (kΩ) | Noise field intensity (dB) |
| 1 | 68.2 | 177~840 | 0.87 | 31.8 | 177~840 | 0.38 | 1.4 | 5.9 | 65.2 |
| 2 | " | " | 0.84 | " | " | " | 1.3 | 5.7 | 65.4 |
| 3 | " | " | 0.74 | " | " | " | 1.1 | 5.6 | 65.9 |
| 4 | " | " | 0.66 | " | " | " | 0.9 | 5.6 | 66.3 |
| 5 | " | " | 0.62 | " | " | " | 0.8 | 5.4 | 67.7 |
| 6 | 68.2 | " | 0.84 | 31.8 | " | 0.62 | 0.7 | 5.6 | 62.1 |
| 7 | " | " | " | " | " | 0.57 | 0.7 | 6.1 | 63.4 |
| 8 | " | " | " | " | " | 0.28 | 1.3 | 5.6 | 66.8 |
| 9 | " | " | " | " | " | 0.24 | 1.4 | 5.4 | 68.5 |
| 10 | 68.2 | " | 0.66 | 31.8 | " | 0.62 | 0.6 | 5.9 | 62.5 |
| 11 | " | " | " | " | " | 0.57 | 0.6 | 5.5 | 63.7 |
| 12 | " | " | " | " | " | 0.28 | 1.1 | 5.8 | 66.5 |
| 13 | " | " | " | " | " | 0.24 | 1.2 | 5.0 | 67.9 |
| 14 | 58.9 | 177~840 | 0.74 | 41.1 | 177~840 | 0.57 | 0.8 | 5.3 | 62.7 |
| 15 | " | " | " | " | " | 0.52 | 1.0 | 5.1 | 63.6 |
| 16 | " | " | " | " | " | 0.38 | 1.2 | 5.4 | 65.5 |
| 17 | " | " | " | " | " | 0.28 | 1.4 | 5.3 | 67.0 |
| 18 | " | " | " | " | " | 0.24 | 1.6 | 5.0 | 68.3 |
| 19 | 48.8 | " | 0.87 | 51.2 | " | 038 | 2.1 | 5.8 | 65.2 |
| 20 | " | " | 0.84 | " | " | " | 1.7 | 5.8 | 66.0 |
| 21 | " | " | 0.74 | " | " | " | 1.5 | 5.4 | 66.7 |

TABLE 15-continued

| | Coarse ceramic particles: molten silica Fine ceramic particles: zircon | | | | | | | | |
|---|---|---|---|---|---|---|---|---|---|
| | Glass powders | | | Ceramic powders | | | | Properties | |
| | | Coarse glass particles | | | Coarse ceramic particles | | | | |
| Run No. | Amount (%) | Particle size (μm) | Ratio | Amount (%) | Particle size (μm) | Ratio | Carbon black (%) | Resistance value (kΩ) | Noise field intensity (dB) |
| 22 | " | " | 0.66 | " | " | " | 1.3 | 5.6 | 67.0 |
| 23 | " | " | 0.62 | " | " | " | 1.1 | 5.6 | 67.4 |
| 24 | 48.8 | " | 0.84 | 51.2 | " | 0.62 | 0.9 | 5.6 | 62.4 |
| 25 | " | " | " | " | " | 0.57 | 1.2 | 5.7 | 63.3 |
| 26 | " | " | " | " | " | 0.28 | 2.2 | 5.4 | 67.0 |
| 27 | " | " | " | " | " | 0.24 | 2.4 | 5.1 | 68.5 |
| 28 | 48.8 | " | 0.66 | 51.2 | " | 0.62 | 0.8 | 5.9 | 63.5 |
| 29 | " | " | " | " | " | 0.57 | 1.0 | 5.8 | 64.2 |
| 30 | " | " | " | " | " | 0.28 | 1.8 | 5.6 | 67.0 |
| 31 | " | " | " | " | " | 0.24 | 2.0 | 5.5 | 68.1 |
| 32 | 58.9 | " | 0.74 | 41.1 | " | 0.52 | 0.1 | 32.1 | 56.6 |
| 33 | " | " | " | " | " | " | 0.5 | 11.3 | 58.4 |
| 34 | " | " | " | " | " | " | 1.5 | 1.3 | 68.7 |
| 35 | " | " | " | " | " | " | 3.0 | 0.1 | 83.8 |
| 36 | 80.0 | 177~840 | 0.9 | 20.0 | — | 0 | 0.08 | 30.0 | 58.9 |
| 37 | " | " | " | " | — | 0 | 0.5 | 10.0 | 59.4 |
| 38 | " | " | " | " | — | 0 | 0.9 | 5.0 | 57.6 |
| 39 | " | " | " | " | — | 0 | 1.4 | 1.0 | 70.3 |
| 40 | " | " | " | " | — | 0 | 2.7 | 0.1 | 85.2 |

TABLE 16

| | Coarse ceramic particles: molten silica Fine ceramic particles: silica | | | | | | | | |
|---|---|---|---|---|---|---|---|---|---|
| | Glass powders | | | Ceramic powders | | | | Properties | |
| | | Coarse glass particles | | | Coarse ceramic particles | | | | |
| Run No. | Amount (%) | Particle size (μm) | Ratio | Amount (%) | Particle size (μm) | Ratio | Carbon black (%) | Resistance value (kΩ) | Noise field intensity (dB) |
| 1 | 75.8 | 177~840 | 0.77 | 24.2 | 177~840 | 0.54 | 1.3 | 5.6 | 65.0 |
| 2 | " | " | 0.72 | " | " | " | 1.3 | 5.2 | 65.2 |
| 3 | " | " | 0.54 | " | " | " | 1.1 | 4.9 | 65.8 |
| 4 | " | " | 0.44 | " | " | " | 0.9 | 4.5 | 67.0 |
| 5 | " | " | 0.39 | " | " | " | 0.9 | 4.7 | 67.5 |
| 6 | 75.8 | " | 0.72 | 24.2 | " | 0.77 | 0.8 | 5.7 | 61.4 |
| 7 | " | " | " | " | " | 0.72 | 0.8 | 5.7 | 62.3 |
| 8 | " | " | " | " | " | 0.44 | 1.3 | 5.1 | 66.8 |
| 9 | " | " | " | " | " | 0.39 | 1.4 | 5.2 | 67.7 |
| 10 | 75.8 | " | 0.44 | 24.2 | " | 0.77 | 0.5 | 6.1 | 62.6 |
| 11 | " | " | " | " | " | 0.72 | 0.6 | 5.5 | 63.1 |
| 12 | " | " | " | " | " | 0.44 | 1.1 | 5.6 | 66.9 |
| 13 | " | " | " | " | " | 0.39 | 1.2 | 5.5 | 68.0 |
| 14 | 69.1 | 177~840 | 0.54 | 30.9 | 177~840 | 0.72 | 0.8 | 5.4 | 63.1 |
| 15 | " | " | " | " | " | 0.68 | 1.0 | 5.0 | 64.1 |
| 16 | " | " | " | " | " | 0.54 | 1.2 | 5.3 | 65.2 |
| 17 | " | " | " | " | " | 0.44 | 1.5 | 5.0 | 67.0 |
| 18 | " | " | " | " | " | 0.39 | 1.8 | 5.3 | 68.5 |
| 19 | 58.2 | " | 0.77 | 41.8 | " | 0.54 | 2.2 | 5.2 | 65.0 |
| 20 | " | " | 0.72 | " | " | " | 1.9 | 5.4 | 66.3 |
| 21 | " | " | 0.54 | " | " | " | 1.6 | 5.6 | 66.5 |
| 22 | " | " | 0.44 | " | " | " | 1.5 | 5.2 | 66.7 |
| 23 | " | " | 0.39 | " | " | " | 1.3 | 5.4 | 67.0 |
| 24 | 58.2 | " | 0.72 | 41.8 | " | 0.77 | 1.0 | 5.8 | 62.1 |
| 25 | " | " | " | " | " | 0.72 | 1.2 | 5.6 | 62.9 |
| 26 | " | " | " | " | " | 0.44 | 2.2 | 5.5 | 66.8 |
| 27 | " | " | " | " | " | 0.39 | 2.4 | 5.7 | 68.6 |
| 28 | 58.2 | " | 0.44 | 41.8 | " | 0.77 | 0.8 | 6.1 | 63.2 |
| 29 | " | " | " | " | " | 0.72 | 1.0 | 5.3 | 64.4 |
| 30 | " | " | " | " | " | 0.44 | 1.8 | 5.3 | 67.0 |
| 31 | " | " | " | " | " | 0.39 | 1.8 | 5.4 | 68.7 |
| 32 | 69.1 | " | 0.54 | 30.9 | " | 0.68 | 0.1 | 30.9 | 55.3 |
| 33 | " | " | " | " | " | " | 0.7 | 8.9 | 57.4 |
| 34 | " | " | " | " | " | " | 1.7 | 1.4 | 68.0 |
| 35 | " | " | " | " | " | " | 3.0 | 0.1 | 82.3 |
| 36 | 80.0 | 177~840 | 0.9 | 20.0 | — | 0 | 0.08 | 30.0 | 58.9 |
| 37 | " | " | " | " | — | 0 | 0.5 | 10.0 | 59.4 |
| 38 | " | " | " | " | — | 0 | 0.9 | 5.0 | 67.6 |
| 39 | " | " | " | " | — | 0 | 1.4 | 1.0 | 70.3 |
| 40 | " | " | " | " | — | 0 | 2.7 | 0.1 | 85.2 |

The results obtained are explained, particularly referring to Table 7 as a typical example.

Figure 7:
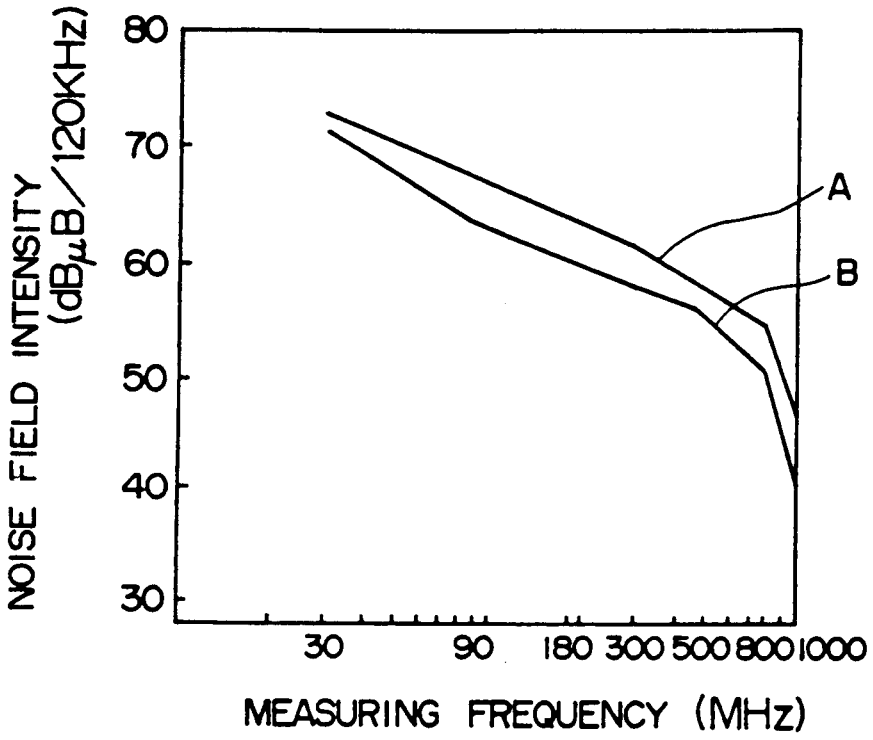
FIG. 7 is a graph for explaining properties obtained by the present invention.

Run Nos. 1 to 33 are Examples and Run Nos. 34 to 40 are Comparative Examples. Results of measured noise field intensities of Run No. 15 (Example: Curve A) and Run No. 38 (Comparative Example: Curve B) are shown in FIG. 7. As shown in Curve A in FIG. 7, the noise field intensities measured at 7 frequencies is mentioned above are reduced almost in parallel. This means that great noise signal suppression effect can be admitted. Further, since noise field intensities of Run Nos. 1 to 33 in Table 7 are reduced almost in parallel in the whole 7 measured frequencies and the noise signal suppression effect is admitted, the noise field intensities at the measured frequency of 90 MHz are shown in Table 7. Further, in Tables 8 to 16, noise field intensities at 90 MHz are also shown.

The resistance values of Run Nos. 34, 35, 39 and 40 in Table 7 are outside the allowable resistance values of 5 kΩ to 30 kΩ±30% specified by JIS D5102. On the other hand, the resistance values of Run Nos. 36, 37, 38 and 40 are within the above-mentioned allowable resistance values, but boundary surfaces between the resistors and the conducting glass seals are remarkably curved. The latter thing can also be said as to Run Nos. 34, 35, 39 and 40.

Figure 8A:
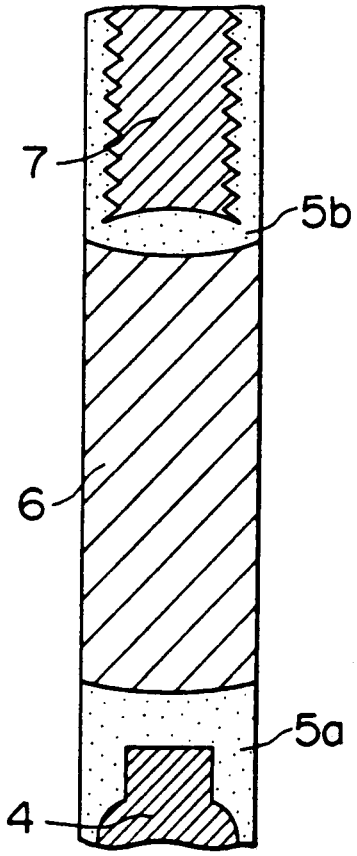
FIGS. 8(*a*) and (*b*) and 9(*a*–9(*c*) are cross-sectional views of the resistors and the conducting glass seals for explaining the present invention.
Figure 8B:
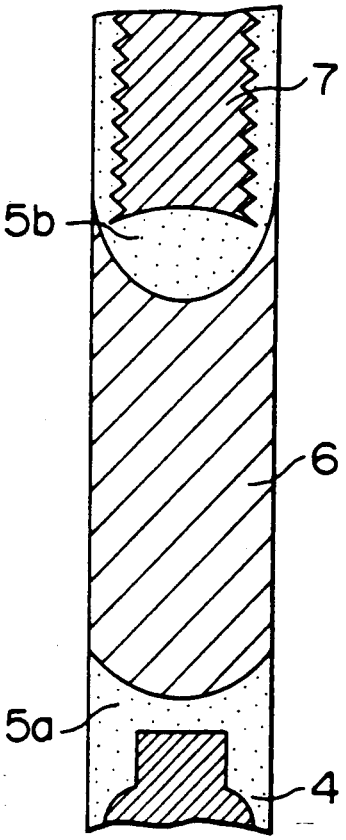

Cross-section of resistor portions of run Nos. 7 and 38 are shown in FIG. 8. The boundary surfaces of resistor 6 contacting with the conducting glass seals 5*a* and 5*b* of Run No. 7 shown in FIG. 8(A) are flat, while those of Run No. 38 shown in FIG. 8(B) are curved.

Figure 9A:
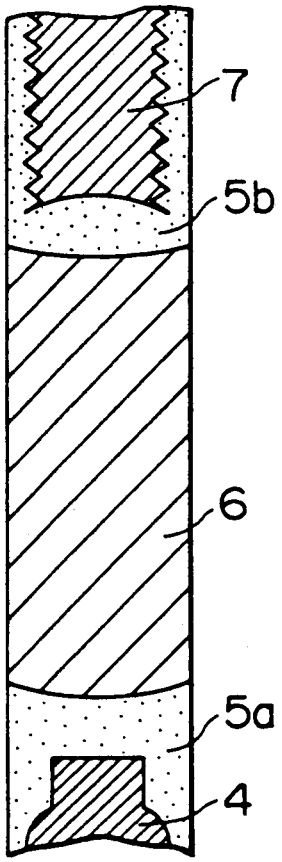
Figure 9B:
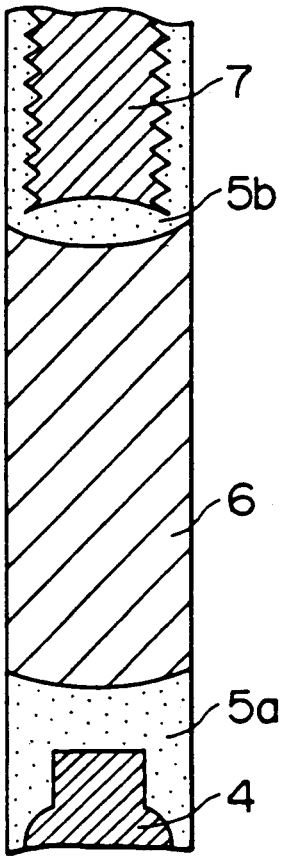
Figure 9C:
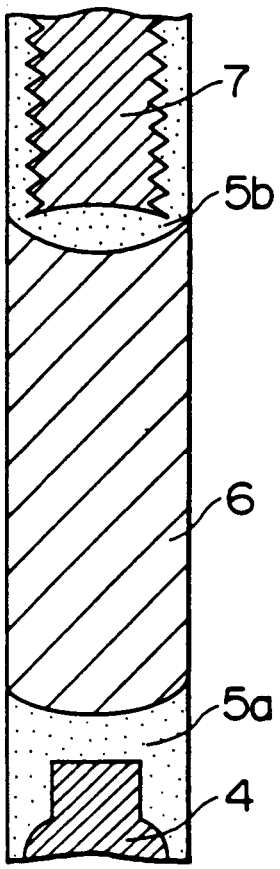

FIGS. 9(A) to 9(C) are cross-sectional views of resistor portions of Run No. 11 (FIG. 9(A)), Run No. 16 (FIG. 9(B)) and Run No. 26 (FIG. 9(C)). The boundary surfaces of Run No. 11 are almost the same as those of Run No. 7 (FIG. 8(A)). In Run No. 16 shown in FIG. 9(B), the boundary surface betwen the resistor 6 and the lower conducting glass seal 5*a* is almost flat, but that between the resistor 6 and the upper conducting glass seal 56 is slightly curved. But the degree of curving of FIG. 9(B) is smaller than that of Run No. 36 shown in FIG. 8(B). In Run No. 26 shown in FIG. 9(C), the upper boundary surface between the resistor 6 and the conducting glass seal 5*b* is more curved than that of Run No. 16 (FIG. 9(B)), but the degree of curving is smaller than that of Run No. 38 shown in FIG. 8(B). Further, the lower boundary surface between the resistor 6 and the conducting glass seal 5*a* of Run No. 26 is almost flat.

As mentioned above, it can be understood that even if one boundary surface between the resistor and either one of upper and lower conducting glass seals is flat and another boundary surface is slightly curved, the substantial length of the resistor is clearly longer than the case wherein both boundary surfaces are curved.

In Tables 7 to 16, the upper and lower limits of mixing of the glass powers and ceramic powders, and the upper and lower limits of the proportion of coarse glass particles and the proportion of coarse ceramic particles shown in Table 1 are shown, but values outside the upper and lower limits are not shown. When the values are outside the upper limit, even if the noise signal suppression effect may be different, the relative resistance change ΔR specified by JIS D5102 is over the range of ±30% of the initial resistance values, resulting in unsuitable for practical use. On the other hand, when the values are outside the lower limit, the noise signal suppression effect cannot be shown at all and the relative resistance change ΔR mentioned above is remarkably increased to make practical use unsuitable.

In the above-mentioned Examples, the fine ceramic particles having an average particle size (D50) of 5 μm are used, but the same results were also obtained when those having a particle size of 10 μm or less were used.

Further, as to glass powder, the same results were also obtained when barium broate glass and barium borosilicate glass were used.

Figure 10A:
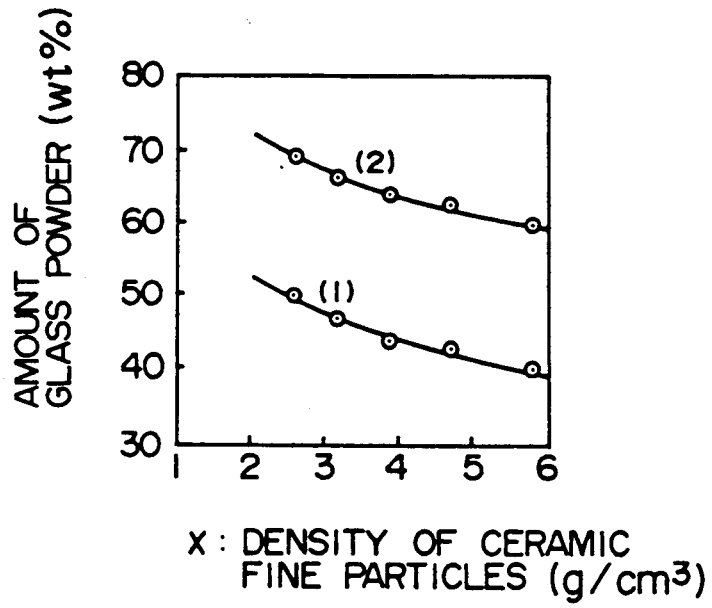
FIGS. 10(*a*) to 10(*c*) are graphs showing properties of the resistor using molten alumina as coarse ceramic particles.
Figure 10B:
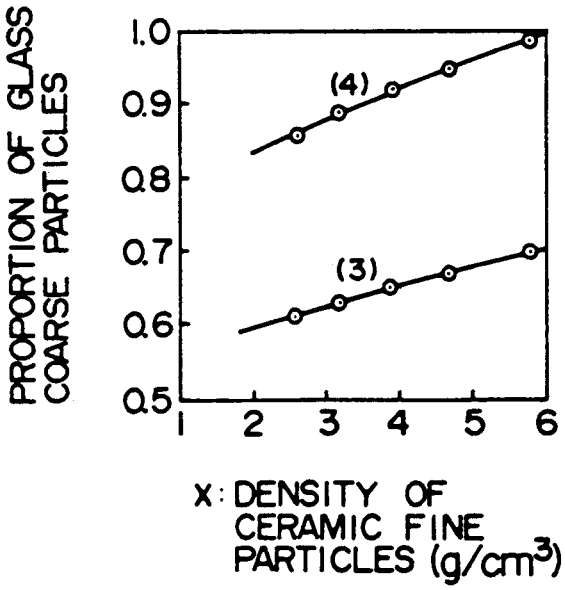
Figure 10C:
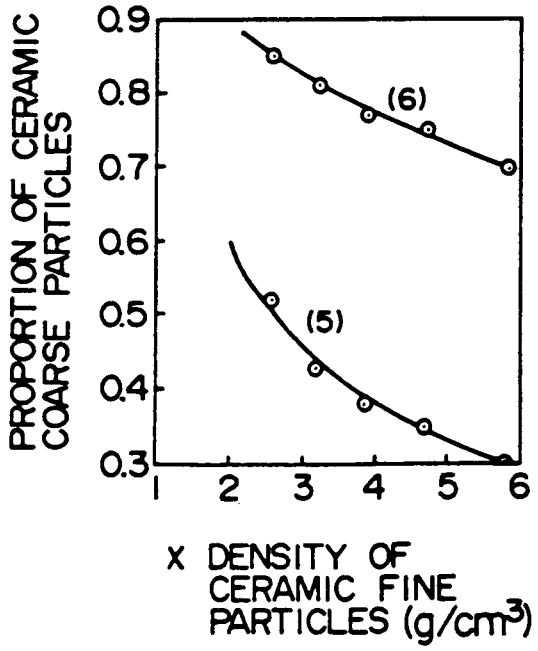
Figure 11A:
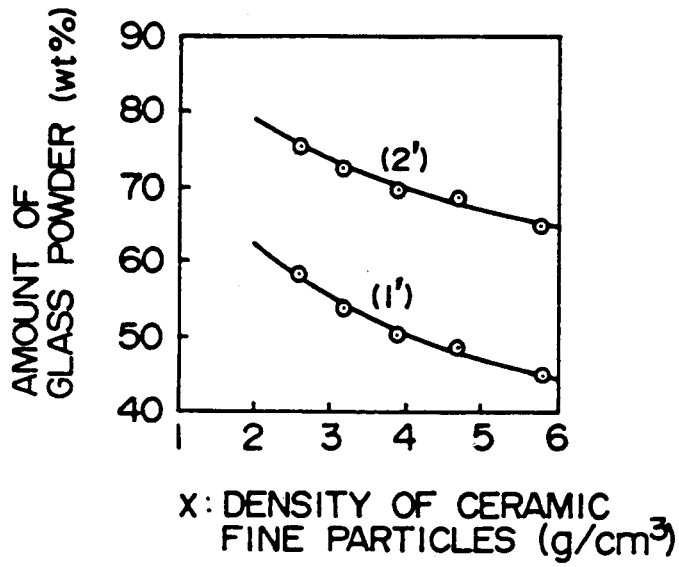
FIGS. 11(*a*) to 11(*c*) are graphs showing properties of the resistor using molten silica as coarse ceramic particles.
Figure 11B:
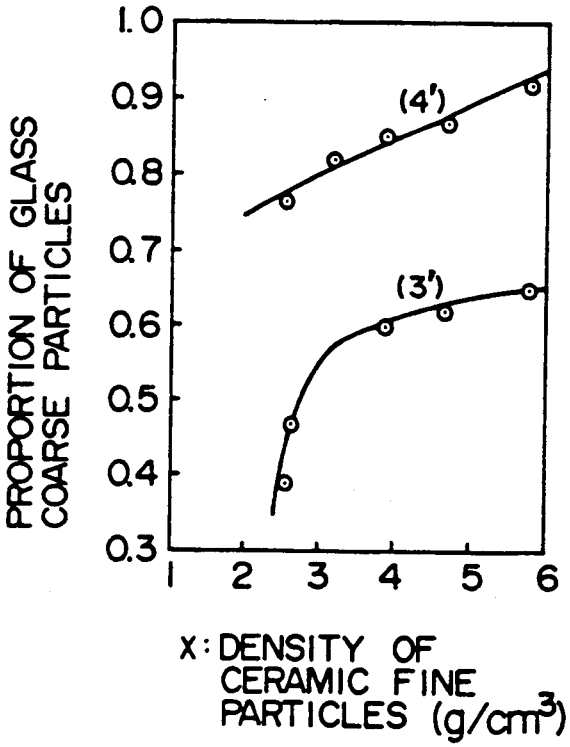
Figure 11C:
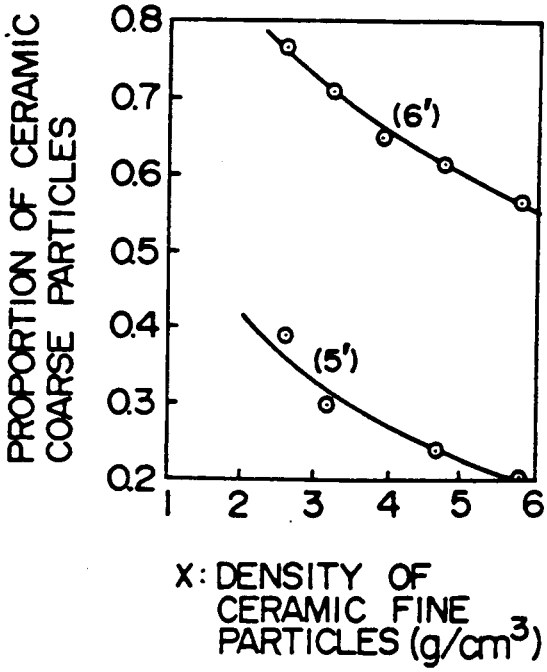

The results of Tables 7 to 16 are summarized in FIGS. 10(*a*) to 10(*c*) and FIGS. 11(*a*) to 11(*c*).

FIGS. 10(*a*) to 10(*c*) show the results when coarse particles of molten alumina are used as the coarse ceramic particles. In FIG. 10(*a*), the amount (% by weight) of glass powders is taken along the ordinate axis and the density of fine ceramic particles (x g/cm$^3$) is taken along the abscissa axis. In FIGS. 10(*b*) and 10(*c*), the proportions of coarse glass particles and coarse ceramic particles are taken along the ordinate axis, respectively, and the density of fine ceramic particles (x g/cm$^3$) is taken along the abscissa axis.

Providing that the density of fine ceramic particles is "x" g/cm$^3$, there can easily be derived the following formulae from the curves shown in FIGS. 10(*a*) to 10(*c*):

the amount of the glass powders in % by weight is preferably in the range between the formulae (1) and (2):

$$65.7-7.5x+0.5x^2 \quad (1)$$

$$82.2-6.1x+0.4x^2 \quad (2)$$

the balance being the amount of the ceramic powders, a total being 100% by weight, the proportion of the coarse glass particles in the glass powders in weight ratio is preferably in the range between the formulae (3) and (4):

$$0.53+0.03x-0.0006x^2 \quad (3)$$

$$0.72+0.06x-0.0030x^2 \quad (4)$$

the balance being the proportion of the fine glass particles, a total being 1, and the proportion of the coarse ceramic particles (i.e. of molten alumina) (c) in the ceramic powders in weight ratio is preferably in the range between the formulae (5) and (6):

$$0.93-0.20x+0.016x^2 \quad (5)$$

$$1.06-0.10x+0.006x^2 \quad (6)$$

the balance being the proportion of the fine ceramic particles, a total being 1.

FIGS. 11(*a*) to 11(*c*) show the results when coarse particles of molten silica are used as the coarse ceramic particles. The ordinate axes and the abscissa axes of FIGS. 11(*a*) to 11(*c*) are the same as those of FIGS. 10(*a*) to 10(*c*).

Providing that the density of fine ceramic particles is "x" g/cm$^3$, there can easily be derived the following formulae from the curves shown in FIGS. 11(*a*) to 11(*c*):

the amount of the glass powders in % by weight is preferably in the range between the formulae (1') and (2'):

$$78.5-9.7x+0.7x^2 \quad (1')$$

of coarse glass particles and coarse ceramic particles, etc.

TABLE 17

| Run No. | Coarse ceramic particles | Fine ceramic particles | Preferable range (calcd.) Amount of glass powders (%) | Ratio of coarse glass particles | Ratio of coarse ceramic particles |
|---|---|---|---|---|---|
| 1 | Molten alumina | Mullite | 47.3–67.1 | 0.62–0.87 | 0.46–0.82 |
| 2 | " | Titania | 43.0–63.6 | 0.65–0.91 | 0.37–0.76 |
| 3 | " | Chromium oxide | 40.2–61.3 | 0.68–0.95 | 0.32–0.72 |
| 4 | Molten silica | Mullite | 55.2–72.8 | 0.51–0.81 | 0.34–0.71 |
| 5 | " | Titania | 50.1–68.4 | 0.63–0.87 | 0.26–0.62 |
| 6 | " | Chromium oxide | 47.0–65.1 | 0.67–0.91 | 0.22–0.57 |

| Run No. | Measured values: Amount of glass powders (%) | Ratio of coarse glass particles | Ratio of coarse ceramic particles | Amount of carbon black | Resistance value (kΩ) | Noise field intensify (dB) |
|---|---|---|---|---|---|---|
| 1 | 66 | 0.8 | 0.8 | 0.9 | 4.9 | 63.1 |
| 2 | 44 | 0.7 | 0.4 | 1.2 | 5.2 | 66.0 |
| 3 | 50 | 0.8 | 0.5 | 1.1 | 5.0 | 64.4 |
| 4 | 71 | 0.7 | 0.6 | 0.7 | 5.3 | 62.7 |
| 5 | 52 | 0.7 | 0.3 | 1.4 | 5.5 | 66.3 |
| 6 | 55 | 0.8 | 0.4 | 1.2 | 5.4 | 65.8 |

$$90.7-7.0x+0.4x^2 \quad (2')$$

the balance being the amount of the ceramic particles, a total being 100% by weight, the proportion of the coarse glass particles in the glass powders in weight ratio is preferably in the range between the formulae (3') and (4'):

$$-0.33+0.39x-0.038x^2 \quad (3')$$

$$0.58+0.09x-0.005x^2 \quad (4')$$

the balance being the proportion of the fine glass particles, a total being 1, and the proportion of the coarse ceramic particles (i.e. of molten silica) in the ceramic powders in weight ratio is preferably in the range between the formulae (5') and (6'):

$$0.75-0.18x+0.015x^2 \quad (5')$$

$$1.10-0.16x+0.011x^2 \quad (6')$$

the balance being the proportion of the fine ceramic particles, a total being 1.

In the next place, the evaluations were conducted in the same manner as mentioned above using the following ceramics as fine ceramic particles:

| | |
|---|---|
| mullite | x = 3.1 g/cm$^3$ |
| titania | x = 4.2 g/cm$^3$ |
| chromium oxide | x = 5.2 g/cm$^3$ |

Most suitable values of the amount of glass powders, the proportion of coarse glass particles and the proportion of coarse ceramic particles (i.e. molten alumina and molten silica) as well as the amount of carbon black, the resistance values and the noise field intensities were obtained and listed in Table 17.

In Table 17, values obtained by using the formulae (1) to (6) and (1') to (6') are also listed in Table 17.

As is clear from Table 17, the formulae (1) to (6) and (1') to (6') are suitable for obtaining most preferable values of the amount of glass powders, the proportions

What is claimed is:

1. A spark plug comprising an insulator having a bore therein along an axis direction, a terminal electrode inserted from one opening of the bore of the insulator and fixed in the bore, a center electrode inserted from another opening of the bore of the insulator and fixed in the bore, a resistor placed between the terminal electrode and the center electrode in the bore of the insulator, and conducting glass seals placed between one end of the resistor and the terminal electrode and between another end of the resistor and the center electrode, said resistor being a sintered body made from a mixture of glass powders, electrical insulating ceramic powders and a carbon black powder in an amount of 0.1 to 2.5% by weight based on 100% by weight of a total of the glass powders and the ceramic powders, said glass powders comprising coarse glass particles of 177 μm to 840 μm in particle size in a weight ratio of 0.39 to 0.99, and fine glass particles of 74 μm or less in particle size in a weight ratio of 0.61 to 0.01, a total being 1, said ceramic powders comprising coarse ceramic particles of molten alumina of 177 μm to 840 μm in particle size in a weight ratio of 0.20 to 0.85, and fine ceramic particles of 10 μm or less in particle size in a weight ratio of 0.80 to 0.15, a total being 1, and the amount of glass powders being 40.0 to 75.8% by weight and that of ceramic powders being 60.0 to 24.2% by weight, a total being 100% by weight.

2. A spark plug comprising an insulator having a bore therein along an axis direction, a terminal electrode inserted from one opening of the bore of the insulator and fixed in the bore, a center electrode inserted from another opening of the bore of the insulator and fixed in the bore, a resister placed between the terminal electrode and the center electrode in the bore of the insulator, and conducting glass seals placed between one end of the resister and the terminal electrode and between another end of the resistor and the center electrode, said resistor being a sintered body made from a mixture of glass powders, electrical insulating ceramic powders and a carbon black powder in an amount of 0.1 to 2.5% by weight based on 100% by weight of a total of the glass powders and the ceramic powders, said glass powders comprising coarse glass particles of 177 μm to 840 μm in particle size and fine glass particles of 74 μm or less in particle size, said ceramic powders comprising coarse ceramic particles of molten alumina of 177 μm to 840 μm in particle size and fine ceramic particles of 10 μm or less in particle size, the amount of the glass powders in % by weight being in the range between the formulae (1) and (2):

$$65.7-7.5x+0.5x^2 \quad (1)$$

$$82.2-6.1x+0.4x^2 \quad (2)$$

wherein x is the density in g/cm$^3$ of fine ceramic particles having a particle size of 10 μm or less, the proportion of the coarse glass particles in the glass powders in weight ratio being in the range between the formulae (3) and (4):

$$0.53+0.03x-0.0006x^2 \quad (3)$$

$$0.72+0.06x-0.0030x^2 \quad (4)$$

wherein x is as defined above, the proportion of the coarse ceramic particles of molten alumina in the ceramic powders in weight ratio being in the range between the formulae (5) and (6):

$$0.93-0.20x+0.016x^2 \quad (5)$$

$$1.06-0.10x+0.006x^2 \quad (6)$$

wherein x is as defined above.

3. A spark plug according to claim 2, wherein the resister is a sintered body made from a mixture of 46.8 to 66.5% by weight of glass powders, and 53.2 to 33.5% by weight of ceramic powders, a total being 100% by weight, and 0.1 to 2.5% by weight of carbon black based on 100% by weight of the glass powders and the ceramic powders, the proportion of the coarse glass particles in the glass powders being 0.63 to 0.89 in weight ratio, the fine ceramic particles being those of silicon nitride, and the proportion of the coarse particles of molten alumina in the ceramic powders being 0.43 to 0.81 in weight ratio.

4. A spark plug according to claim 2, wherein the resistor is a sintered body made from a mixture of 40.0 to 60.0% by weight of glass powders and 60.0 to 40.0% by weight of ceramic powders, a total being 100% by weight, and 0.1 to 2.5% by weight of carbon black based on 100% by weight of the glass powders and the ceramic powders, the proportion of the coarse glass particles in the glass powders being 0.70 to 0.99 in weight ratio, the fine ceramic particles being those of zirconia, and the proportion of the coarse particles of molten alumina in the ceramic powders being 0.30 to 0.70 in weight ratio.

5. A spark plug according to claim 2, wherein the resistor is a sintered body made from a mixture of 44.0 to 64.0% by weight of glass powders and 56.0 to 36.0% by weight of ceramic powders, a total being 100% by weight, and 0.1 to 2.5% by weight of carbon black based on 100% by weight of the glass powders and the ceramic powders, the proportion of the coarse glass particles in the glass powders being 0.65 to 0.92 in weight ratio, the fine ceramic particles being those of alumina, and the proportion of the coarse particles of molten alumina in the ceramic powders being 0.38 to 0.77 in weight ratio.

6. A spark plug according to claim 2, wherein the resistor is a sintered body made from a mixture of 42.8 to 62.7% by weight of glass powders and 57.2 to 37.3% by weight of ceramic powders, a total being 100% by weight, and 0.1 to 2.5% by weight of carbon black based on 100% by weight of the glass powders and the ceramic powers, the proportion of the coarse glass particles in the glass powders being 0.67 to 0.95 in weight ratio, the fine ceramic particles being those of zircon, and the proportion of the coarse particles of molten alumina in the ceramic powders being 0.35 to 0.74 in weight ratio.

7. A spark plug according to claim 2, wherein the resistor is a sintered body made from a mixture of 50.0 to 69.2% by weight of glass powders and 50.0 to 30.8% by weight of ceramic powders, a total being 100% by weight, and 0.1 to 2.5% by weight of carbon black based on 100% by weight of the glass powders and the ceramic powders, the proportion of the coarse glass particles in the glass powders being 0.61 to 0.86 in weight ratio, the fine ceramic particals being those of silica, and the proportion of the coarse particles of molten alumina in the ceramic powders being 0.52 to 0.85 in weight ratio.

8. A spark plug comprising an insulator having a bore therein along an axis direction, a terminal electrode inserted from one opening of the bore of the insulator and fixed in the bore, a center electrode inserted from another opening of the bore of the insulator and fixed in the bore, a resistor placed between the terminal electrode and the center electrode in the bore of the insulator, and conducting glass seals placed between one end of the resistor and the terminal electrode and between another end of the resistor and the center electrode, said resistor being a sintered body made from a mixture of glass powders, electrical insulating ceramic powders and a carbon black powder in an amount of 0.1 to 2.5% by weight based on 100% by weight of a total of the glass powders and the ceramic powders, said glass powders comprising coarse glass particles of 177 μm to 840 μm in particle size and fine glass particles of 74 μm or less in particle size, said ceramic powders comprising coarse ceramic particals of molten silica of 177 μm to 840 μm in particle size and fine ceramic particles of 10 μm or less in particle size, the amount of the glass powders in % by weight being in the range between the formulae (1') and (2'):

$$78.5-9.7x+0.7x^2 \quad (1')$$

$$90.7-7.0x+0.4x^2 \quad (2')$$

wherein x is the density in g/cm$^3$ of fine ceramic particles having a particle size of 10 μm or less, the proportion of the coarse glass particles in the glass powders in weight ratio being in the range between the formulae (3') and (4'):

$$-0.33+0.39x-0.038x^2 \quad (3')$$

$$0.58+0.09x-0.005x^2 \quad (4')$$

wherein x is as defined above, the proportion of the coarse ceramic particles of molten silica in the ceramic powders in weight ratio being in the range between the formulae (5') and (6'):

$$0.75-0.18x+0.015x^2 \quad (5')$$

$$1.10-0.16x+0.011x^2 \quad (6')$$

wherein x is as defined above.

9. A spark plug according to claim 8, wherein the resister is a sintered body made from a mixture of 53.9 to 72.6% by weight of glass powders, and 46.1 to 27.4% by weight of ceramic powders, a total being 100% by weight, and 0.1 to 2.5% by weight of carbon black based on 100% by weight of the glass powders and the ceramic powders, the proportion of the coarse glass particles in the glass powders being 0.58 to 0.82 in weight ratio, the fine ceramic particles being those of silicon nitride, and the proportion of the coarse particles of molten silica in the ceramic powders being 0.30 to 0.71 in weight ratio.

10. A spark plug according to claim 8, wherein the resistor is sintered body made from a mixture of 45.1 to 64.9% by weight of glass powders and 54.9 to 35.1% by weight of ceramic powders, a total being 100% by weight, and 0.1 to 2.5% by weight of carbon black based on 100% by weight of the glass powders and the ceramic powders, the proportion of the coarse glass particles in the glass powders being 0.65 to 0.92 in weight ratio, the fine ceramic particles being those of zirconia, and the proportion of the coarse particles of molten silica in the ceramic powders being 0.20 to 0.57 in weight ratio.

11. A spark plug according to claim 8, wherein the resistor is a sintered body made from a mixture of 50.4 to 69.7% by weight of glass powders and 49.6 to 30.3% by weight of ceramic powders, a total being 100% by weight, and 0.1 to 2.5% by weight of carbon black based on 100% by weight of the glass powders and the ceramic powders, the proportion of the coarse glass particles in the glass powders being 0.60 to 0.85 in weight ratio, the fine ceramic particles being those of alumina, and the proportion of the coarse particles of molten silica in the ceramic powders being 0.23 to 0.65 in weight ratio.

12. A spark plug according to claim 8, wherein the resistor is a sintered body made from a mixture of 48.8 to 68.2% by weight of glass powders and 51.2 to 31.8% by weight of ceramic powders, a total being 100% by weight, and 0.1 to 2.5% by weight of carbon black based on 100% by weight of the glass powders and the ceramic powders, the proportion of the coarse glass particles in the glass powders being 0.62 to 0.87 in weight ratio, the fine ceramic particles being those of alumina, and the proportion of the coarse particles of molten silica in the ceramic powders being 0.24 to 0.62 in weight ratio.

13. A spark plug according to claim 8, wherein the resistor is a sintered body made from a mixture of 58.2 to 75.8% by weight of glass powders and 41.8 to 24.2% by weight of ceramic powders, a total being 100% by weight, and 0.1 to 2.5% by weight of carbon black based on 100% by weight of the glass powders and the ceramic powders, the proportion of the coarse glass particles in the glass powders being 0.39 to 0.77 in weight ratio, the fine ceramic particles being those of silica, and the proportion of the coarse particles of molten silica in the ceramic powders being 0.39 to 0.77 in weight ratio.

14. A spark plug according to claim 2, wherein the coarse glass particles have a particle size of 250 μm to 840 μm, the fine glass particles have a particle size of 10 μm to 74 μm, and the fine ceramic particles have a particle size of 0.1 ρm to 10 μm.

15. A spark plug according to claim 8, wherein the coarse glass particles have a particle size of 250 μm to 840 μm, the fine glass particles have a particle size of 10 μm to 74 μm, and the fine ceramic particles have a particle size of 0.1 μm to 10 μm.

16. A spark plug according to claim 2, wherein the fine ceramic particles are selected from the group consisting of silicon nitride, zirconia, alumina, zircon, silica, mullite, titania and chromium oxide.

17. A spark plug according to claim 8, wherein the fine ceramic particles are selected from the group consisting of silicon nitride, zirconia, alumina, zircon, silica, mullite, titania and chromium oxide.

18. A spark plug according to claim 2, wherein the resistor is a sintered body made from a mixture of 47.3 to 67.1% by weight of glass powders and 52.7 to 32.9% by weight of ceramic powders, a total being 100% by weight, and 0.1 to 2.5% by weight of carbon black based on 100% by weight of the glass powders and the ceramic powders, the proportion of the coarse glass particles in the glass powders being 0.62 to 0.87 in weight ratio, the fine ceramic particals being those of mullite, and the proportion of the coarse particles of molten alumina in the ceramic powders being 0.62 to 0.87 in weight ratio.

19. A spark plug according to claim 2, wherein the resistor is a sintered body made from a mixture of 43.0 to 63.6% by weight of glass powders and 57.0 to 36.4% by weight of ceramic powders, a total being 100% by weight, and 0.1 to 2.5% by weight of carbon black based on 100% by weight of the glass powders and the ceramic powders, the proportion of the coarse glass particles in the glass powders being 0.65 to 0.91 in weight ratio, the fine ceramic particle being those of titania, and the proportion of the coarse particles of molten alumina in the ceramic powders being 0.37 to 0.76 in weight ratio.

20. A spark plug according to claim 2, wherein the resistor is a sintered body made from a mixture of 40.2 to 61.3% by weight of glass powders and 59.8 to 38.7% by weight of ceramic powders, a total being 100% by weight, and 0.1 to 2.5% by weight of carbon black based on 100% by weight of the glass powders and the ceramic powders, the proportion of the coarse glass particles in the glass powders being 0.68 to 0.95 in weight ratio, the fine ceramic particals being those of chromium oxide and the proportion of the coarse particles of molten alumina in the ceramic powders being 0.32 to 0.72 in weight ratio.

21. A spark plug according to claim 8, wherein the resistor is a sintered body made from a mixture of 55.2 to 72.8% by weight of glass powders and 44.8 to 27.2% by weight of ceramic powders, a total being 100% by weight, and 0.1 to 2.5% by weight of carbon black based on 100% by weight of the glass powders and the ceramic powders, the proportion of the coarse glass particles in the glass powders being 0.51 to 0.81 in weight ratio, the fine ceramic particals being those of mullite, and the proportion of the coarse particles of molten silica in the ceramic powders being 0.34 to 0.71 in weight ratio.

22. A spark plug according to claim 8, wherein the resistor is a sintered body made from a mixture of 50.1 to 68.4% by weight of glass powders and 49.9 to 31.6% by weight of ceramic powders, a total being 100% by weight, and 0.1 to 2.5% by weight of carbon black based on 100% by weight of the glass powders and the ceramic powders, the proportion of the coarse glass particles in the glass powders being 0.63 to 0.87 in weight ratio, the fine ceramic particals being those of titania, and the proportion of the coarse particles of molten silica in the ceramic powders being 0.26 to 0.62 in weight ratio.

23. A spark plug according to claim 8, wherein the resistor is a sintered body made from a mixture of 47.0 to 65.1% by weight of glass powders and 53.0 to 34.9% by weight of ceramic powders, a total being 100% by weight, by weight of the glass powders and the ceramic powders, the proportion of the coarse glass particles in the glass powders being 0.67 to 0.91 in weight ratio, the fine ceramic particals being those of chromium oxide and the proportion of the coarse particles of molten silica in the ceramic powders being 0.22 to 0.57 in weight ratio.

* * * * *